US005987294A

United States Patent [19]

Yoda et al.

[11] Patent Number: 5,987,294

[45] Date of Patent: Nov. 16, 1999

[54] TONER FIXING APPARATUS

[75] Inventors: Kaneo Yoda; Kenjiro Yoshioka; Hiroshi Tanaka; Yoshiro Koga; Kazutoshi Fujisawa; Takayuki Shiraki; Naoyuki Okumura, all of Nagano, Japan

[73] Assignee: Seiko Epson Corporation, Tokyo, Japan

[21] Appl. No.: 09/016,279

[22] Filed: Jan. 30, 1998

[30] Foreign Application Priority Data

| | | | |
|---|---|---|---|
| Jan. 31, 1997 | [JP] | Japan | 9-32997 |
| Jan. 31, 1997 | [JP] | Japan | 9-32998 |
| Feb. 28, 1997 | [JP] | Japan | 9-46446 |
| Feb. 28, 1997 | [JP] | Japan | 9-46447 |
| Dec. 12, 1997 | [JP] | Japan | 9-362926 |
| Dec. 12, 1997 | [JP] | Japan | 9-362927 |
| Dec. 12, 1997 | [JP] | Japan | 9-362928 |

[51] Int. Cl.[6] ..... G03G 15/20

[52] U.S. Cl. ..... 399/328; 399/322; 399/325

[58] Field of Search ..... 399/328, 331, 399/322, 324, 325; 219/216, 243, 244; 430/124; 118/DIG. 1

[56] References Cited

U.S. PATENT DOCUMENTS

| | | | |
|---|---|---|---|
| 4,315,682 | 2/1982 | Parzanici | 399/322 |
| 4,714,427 | 12/1987 | Tsuruoka et al. | 432/59 |
| 5,047,809 | 9/1991 | Owada et al. | 399/325 |
| 5,157,447 | 10/1992 | Farnand et al. | 399/331 |
| 5,245,393 | 9/1993 | Storlie et al. | 399/322 |
| 5,255,060 | 10/1993 | Chikano | 399/331 |
| 5,614,999 | 3/1997 | Kanesawa et al. | 219/216 X |
| 5,623,331 | 4/1997 | Kaneko et al. | 399/378 |
| 5,749,036 | 5/1998 | Yoda et al. | 399/325 |

FOREIGN PATENT DOCUMENTS

| | | |
|---|---|---|
| 55-29822 | 3/1980 | Japan . |
| 58-21262 | 4/1983 | Japan . |
| 2-143282 | 6/1990 | Japan . |
| 3-267975 | 11/1991 | Japan . |
| 5-63795 | 9/1993 | Japan . |
| 5-273881 | 10/1993 | Japan . |
| 7-219366 | 8/1995 | Japan . |

*Primary Examiner*—Sandra Brase
*Assistant Examiner*—Sophia S. Chen
*Attorney, Agent, or Firm*—Sughrue, Mion, Zinn, Macpeak & Seas, PLLC

[57] ABSTRACT

A fixing apparatus including a heat roller having a heat source therein; and first and second pressing rollers arranged to be pressed sequentially against the heat roller beginning with a more upstream pressing roller in a direction of rotation of the heat roller, wherein when the hardness of the heat roller is Hh, the hardness of the first pressing roller is Hp1 and the ratio of the hardness of the two rollers satisfies Hr1=Hh/Hp1, the heat roller and the first pressing roller are structured in such a manner that the following condition is satisfied: Hr1≧1.5.

27 Claims, 15 Drawing Sheets

| FIXING UNIT | A | B | C | D | E | F | G | H | I | J |
|---|---|---|---|---|---|---|---|---|---|---|
| HEAT ROLLER DIAMETER mm | 35 | 35 | 35 | 35 | 35 | 35 | 35 | 35 | 35 | 35 |
| THICKNESS OF RUBBER mm | 2 | 2 | 2 | 2 | 1.5 | 1 | 1 | 0.4 | 1 | 2 |
| HARDNESS Hh JISA | 48 | 48 | 48 | 48 | 57 | 65 | 65 | 90 | 80 | 48 |
| PRESSING ROLLER DIAMETER mm | 35 | 35 | 35 | 35 | 35 | 35 | 35 | 35 | 35 | 35 |
| THICKNESS OF RUBBER mm | 2 | 2 | 2 | 2 | 4 | 1.5 | 1.5 | 5 | 5 | 2 |
| HARDNESS Hp JISA | 69 | 63 | 58 | 48 | 50 | 48 | 43 | 25 | 25 | 32 |
| HARDNESS RATIO Hr Hh/Hp | 0.7 | 0.76 | 0.83 | 1.00 | 1.14 | 1.35 | 1.51 | 3.60 | 3.20 | 1.5 |
| QUANTITY OF OIL mg/cm2 | 0 | 0.001587 | 0.003175 | 0.006349 | 0.009524 | 0.015873 | 0.015873 | 0.015873 | 0.015873 | 0.003175 |
| mg/a4 | 0 | 1 | 2 | 4 | 6 | 10 | 10 | 10 | 10 | 2 |
| HAZE | 10 | 12.5 | 15 | 20 | 25 | 35 | 25 | 23 | 24 | 12 |
| WINDING | NO | NO | NO | NO | NO | NO | YES | YES | YES | YES |

FIG. 5

| FIXING UNIT | A' | B' | C' | D' | E' | F' | G' | J' |
|---|---|---|---|---|---|---|---|---|
| HEAT ROLLER DIAMETER mm | 35 | 35 | 35 | 35 | 35 | 35 | 35 | 35 |
| THICKNESS OF RUBBER mm | 2 | 2 | 2 | 2 | 2 | 2 | 2 | 2 |
| HARDNESS Hh JISA | 48 | 48 | 48 | 48 | 57 | 48 | 48 | 48 |
| PRESSING ROLLER DIAMETER mm | 15 | 15 | 15 | 35 | 35 | 35 | 35 | 15 |
| THICKNESS OF RUBBER mm | 2 | 2 | 2 | 2 | 2 | 2 | 2 | 2 |
| HARDNESS Hp JISA | 70 | 80 | 59 | 58 | 50 | 48 | 48 | 80 |
| HARDNESS RATIO Hr Hh/Hp | 0.69 | 0.60 | 0.81 | 0.83 | 1.14 | 1.00 | 1.00 | 0.6 |
| QUANTITY mg/cm2 | 0 | 0 | 0 | 0.006349 | 0.006349 | 0.009524 | 0.003175 | 0.003175 |
| OF OIL mg/a4 | 0 | 0 | 0 | 4 | 4 | 6 | 2 | 2 |
| HAZE | 10 | 12 | 8 | 24 | 16 | 30 | 13 | 16 |
| WINDING | NO | NO | YES | NO | YES | NO | YES | NO |

FIG. 6

TONER FIXING APPARATUS

BACKGROUND OF INVENTION

The present invention relates to a fixing apparatus of an image forming apparatus, such as a printer, a facsimile machine or a copying machine, for fixing a toner image carried on a. sheet (plain paper, coat paper, an OHP (Over Head Projector) sheet, glossy paper, a cut sheet, such as a postcard or an envelope) to the surface of a sheet. More particularly, the present invention relates to a fixing apparatus having two pressing rollers which are pressed against one heat roller.

Hitherto, a fixing apparatus has been disclosed (refer to Japanese Patent Publication No. Sho. 58-21262) which is structured as shown in FIG. 8 in such a manner that two pressing rollers are sequentially pressed against one pressing roller beginning with a more upstream pressing roller in a direction of rotation of the one pressing roller.

The apparatus disclosed in Japanese Patent Publication No. Sho. 58-21262 has two pressing rollers, which are arranged in such a manner that a downstream pressing roller has a higher circumferential speed, or a pressing belt arranged between two rollers. Thus, a recording medium moved to the surface of the heat roller is brought into contact with the wide area of the two rollers or the pressing belt. As a result, toner can efficiently be softened at lower temperatures.

As described above, the conventional fixing apparatus shown in FIG. 8 has the structure that the circumferential speed of the pressing roller 3 is higher than that of the pressing roller 2. Therefore, a tension is applied to the sheet between the pressing rollers 2 and 3 after the leading end of the sheet has been allowed to pass through a pressing portion between the pressing roller 2 and the heat roller 1, and then allowed to pass through a pressing portion between the pressing roller 3 and the heat roller 1. As a result, the sheet can satisfactorily be brought into contact with the heat roller 1. That is, the tension is not applied to the sheet before the leading end of the sheet reaches the pressing portion between the pressing roller 3 and the heat roller 1. As a result, the sheet cannot satisfactorily be brought into contact with the heat roller 1.

That is, the conventional apparatus shown in FIG. 8 encounters considerably great difference in the heating value which is applied to toner on the sheet before and after the leading end reaches the pressing portion by the pressing roller heat roller 1. Thus, there arises a problem in that nonuniformity (nonuniformity in the strength of fixation, the color development characteristic, the transparency and the like) takes place in the leading end portion and the central portion of the sheet. Also the trailing end of the sheet has a similar problem. That is, the heating value, which is applied to toner on the sheet, becomes considerably different before and after period until the trailing end of the sheet passes through the pressing portion by the pressing roller 2 and the heat roller 1. As a result, results of the fixing operation have nonuniformity between the central portion of the sheet and the trailing end portion of same.

Although the above-mentioned structure attains an effect of softening the toner, the conventional structure has a problem in that a large quantity of stacked toner layers cannot satisfactorily strongly be fixed to the surface of a recording medium. Another problem arises in that a required result of the fixing operation by using heat cannot be obtained because the temperature of the recording medium is lowered during a period in which the wide areas of the recording medium and the heat roller are brought into contact with each other. What is worse, a slight difference in the speed between the heat roller and the pressing roller can result in a toner image, the surface of which is brought into contact with the rollers, being disordered.

A fixing apparatus has been known which is of a type having a heat roller and a pressing roller arranged to be pressed against the heat roller and structured in such a manner that a sheet having toner thereon is allowed to pass through the two rollers to heat, melt and fix toner to the surface of the sheet. There is apprehension that the fixing apparatus of the foregoing type encounters a problem that the sheet is wound around the heat roller because of the adhesive force of molten toner. If a color image is obtained by melting and fixing toner images in a plurality of colors stacked on a sheet, transparency must be realized by sufficiently heating, melting and mixing stacked toner in the plural colors. Therefore, the sheet can furthermore easily be wound around the heat roller.

On the other hand, an inventor of the present invention has found that the transparency of a toner image deteriorates if a large quantity of oil is applied to the surface of the heat roller. The reason for this will now be described. If oil in a large quantity is applied to the surface of the heat roller, the toner is heated and melted under the pressure through the large quantity of oil. As a result, the pressure of the surface of the heat roller is dispersed by the layer of the large quantity of oil, causing the smoothness of the surface of the heat roller not to be reflected on the surface of toner. Thus, it is conceivable that the resulting irregular reflection will deteriorate the transparency.

SUMMARY OF INVENTION

A first object of the present invention is to provide a fixing apparatus, which is capable of solving the above-mentioned problems, and which enables an image free from nonuniform fixation on the entire surface of the sheet and exhibiting excellent transparency to be obtained.

A second object of the present invention is to provide a fixing apparatus having a structure that two pressing rollers have a function of melting toner and a function of fixing toner to a recording medium respectively so as to be capable of furthermore quickly and reliably fixing a toner image.

A third object of the present invention is to provide a fixing apparatus having a heat preservation means disposed between two pressing rollers so as to quickly recover the heat roller to enable a high-duty fixing process to be quickly and reliably be completed.

A fourth object of the present invention is to provide a fixing apparatus having a structure in which two pressing rollers have a function of melting toner and a function of fixing toner to a recording medium respectively so as to be capable of quickly fixing a toner image without the occurrence of any crease and curl.

To achieve the above-mentioned objects, a fixing apparatus according to the invention comprises a heat roller having a heat source therein; and first and second pressing rollers arranged to sequentially be pressed against the heat roller beginning with a more upstream pressing roller in a direction of rotations of the heat roller, wherein when an assumption is made that the hardness of the heat roller is Hh, the hardness of the first pressing roller is Hp1 and the ratio of the hardness of the two rollers satisfies $Hr1=Hh/Hp1$, the heat roller and the first pressing roller are structured in such a manner that the following condition is satisfied: $Hr1 \geqq 1.5$.

Futhermore, in a fixing apparatus described above, when an assumption is made that the hardness of the second pressing roller is Hp2 and the ratio of hardness to that of the heat roller satisfies Hr2=Hh/Hp2, the heat roller and the second pressing roller are structured in such a manner that the following condition is satisfied: Hr2≦0.7.

According to another aspect of the invention, there is provided a fixing apparatus comprising a heat roller having a heat source therein; and first and second pressing rollers arranged to be pressed sequentially against the heat roller beginning with a more upstream pressing roller in a direction of rotations of the heat roller, wherein the hardness of the first pressing roller is made to be lower than the hardness of the heat roller, and the quantity of oil which is applied to the heat roller is 0.0063 mg/cm$^2$ or smaller.

According to a further aspect of the invention, there is provided a fixing apparatus comprises a heat roller having a heat source therein; and first and second pressing rollers arranged to be pressed sequentially against the heat roller beginning with a more upstream pressing roller in a direction of rotations of the heat roller, wherein when an assumption is made that the quantity of oil which is applied to the heat roller is Y mg/cm$^2$, the hardness of the heat roller is Hh, the hardness of the first pressing roller is Hp1 and the ratio of hardness of the two rollers satisfies Hr1=Hh/Hp1, the quantity Y of oil is 0.0063 mg/cm$^2$ or smaller, and the heat roller and the first pressing roller are structured in such a manner that the following condition is satisfied Y<0.021−Hr1−0.0147.

Futhermore, a fixing apparatus described above further comprises a second pressing roller, wherein when an assumption is made that the hardness of the second pressing roller is Hp2 and the ratio of hardness to that of the heat roller satisfies Hr2=Hh/Hp2, the heat roller and the second pressing roller are structured in such a manner that the following condition is satisfied: Y≧0.021×Hr2−0.0147.

According to a still further aspect of the invention, there is provided a fixing apparatus comprising two pressing rollers disposed in contact with a heat roller at upstream and downstream positions respectively in a direction of rotations of the heat roller in a region in which the contact with a recording medium is made, wherein the pressing roller disposed in the upstream position is caused to have a main function of melting toner and the pressing roller disposed at the downstream position is caused to have a main function of fixing toner to a recording medium.

According to a still further apsect of the invention, there is provided a fixing appratus comprising two pressing rollers disposed to be in contact with a heat roller at upstream and downstream positions respectively in a direction of rotation of the heat roller in a region in which contact with a recording medium is made; and a recording-medium guide means disposed between the two pressing rollers and structured to cover the surface of the heat roller so as to have a function of preventing heat radiation from the heat roller.

According to a still further aspect of the invention, there is provided a fixing apparatus comprising two pressing rollers disposed to be in contact with a heat roller at upstream and downstream positions respectively in a direction of rotations of the heat roller in a region in which the contact with a recording medium is made, wherein the curvature radius of a nipping portion of the pressing roller disposed in the upstream position is made to be larger than the curvature radius of the heat roller and that of the pressing roller disposed at the upstream position.

According to a still further aspect of the invention, there is provided a fixing apparatus comprising two pressing rollers disposed to be in contact with a heat roller at upstream and downstream positions respectively in a direction of rotations of the heat roller in a region in which the contact with a recording medium is made, wherein the temperature of the surface of the nipping portion of the pressing roller disposed in the upstream position is made to be lower than the temperature of the surface of the nipping portion of the pressing roller disposed at the downstream position.

The fixing apparatus according to the present invention comprises a heat roller having a heat source therein; and first and second pressing rollers arranged to sequentially be pressed against the heat roller beginning with a more upstream pressing roller in a direction of rotations of the heat roller, wherein when an assumption is made that the hardness of the heat roller is Hh, the hardness of the first pressing roller is Hp1 and the ratio of the hardness of the two rollers satisfies Hr1=Hh/Hp1, the heat roller and the first pressing roller are structured in such a manner that the following condition is satisfied: Hr1≧1.5. Therefore, the foregoing apparatus attains the following effect:

If the ratio Hr1=Hh/Hp1 of the hardness of the heat roller and the first pressing roller is not smaller than 1.5, the pressing portion (a first nipping portion) between the heat roller and the first pressing roller has a shape that the first pressing roller portion is considerably recessed when the shape is viewed from the axial direction of the roller. Thus, the sheet allowed to pass through the first nipping portion and including the leading end thereof is greatly deformed in a direction in which the sheet is wound around the heat roller. As a result, the leading end of the sheet is discharged from the first nipping portion in a state in which the leading end of the sheet is in contact with the heat roller or considerably closes the same regardless whether toner is placed on the sheet. Moreover, the sheet is reliably wound around the heat roller beginning with the leading end of the sheet because van der Waals force and image force act on the space between the sheet and the heat roller.

When the sheet allowed to pass through the first nipping portion is reliably wound around the heat roller beginning with the leading end of the sheet, toner is melted at a stroke if toner exists at the leading end of the sheet. As a result, a further stable state of contact with the heat roller can be realized.

Therefore, the fixing apparatus described above is able to realize a state of fixation in which the sheet is free from nonuniformity in its entirety.

If the ratio Hr1of the hardness between the heat roller and the first pressing roller is made to be 1.5 or higher as described above, the sheet allowed to pass through the first nipping portion is reliably wound around the heat roller beginning with its leading end. Then, the sheet is introduced into the pressing portion (a second nipping portion) between the heat roller and the second pressing roller. If no countermeasure is taken, there is apprehension that the sheet which must be separated from the heat roller after it has been allowed to pass through the second nipping portion is wound around the heat roller. Although a separation claw is required to separate the sheet allowed to pass through the second nipping portion from the heat roller, it is preferable that the separating operation is performed smoothly.

Furthermore, in the fixing apparatus, when an assumption is made that the hardness of the second pressing roller is Hp2 and the ratio of hardness to that of the heat roller satisfies Hr2=Hh/Hp2, the heat roller and the second pressing roller are structured in such a manner that the following condition is satisfied: Hr2≦0.7. Therefore, the following effect can be obtained.

If the ratio Hr2=Hh/Hp2 of the hardness of the heat roller and the second pressing roller is not more than 0.7, the pressing portion (a second nipping portion) between the heat roller and the second pressing roller has a shape that the heat roller portion is considerably recessed when the shape is viewed from the axial direction of the roller. Thus, the sheet allowed to pass through the second nipping portion and including the leading end thereof is deformed in a direction in which the sheet is not wound around the heat roller. Then, the leading end of the sheet is discharged from the second nipping portion.

Therefore, the fixing apparatus described above enables the sheet allowed to pass through the second nipping portion to be separated from the heat roller even if a separating claw is omitted despite the structure that the ratio Hr1 of the hardness between the heat roller and the first pressing roller is 1.5 or higher.

That is, the fixing apparatus described above is able to realize a state of fixation free from any nonuniformity in its entirety. Moreover, the sheet can smoothly be separated from the heat roller.

The fixing apparatus according to another aspect of the invention comprises a heat roller having a heat source therein; and first and second pressing rollers arranged to sequentially be pressed against the heat roller beginning with a more upstream pressing roller in a direction of rotations of the heat roller, wherein the hardness of the first pressing roller is made to be lower than the hardness of the heat roller, and the quantity of oil which is applied to the heat roller is 0.0063 mg/cm$^2$ or smaller. Thus, the foregoing apparatus attains the following effect.

If the hardness of the first pressing roller is smaller than that of the heat roller, the pressing portion (a first nipping portion) between the heat roller and the first pressing roller has a shape that the first pressing roller portion is considerably recessed when the shape is viewed from the axial direction of the roller. Thus, the sheet allowed to pass through the first nipping portion and including the leading end thereof is deformed in a direction in which the sheet is wound around the heat roller. As a result, the leading end of the sheet is discharged from the first nipping portion in a state in which the leading end of the sheet is in contact with the heat roller or considerably closes the same regardless whether toner is placed on the sheet. Moreover, the sheet can easily be wound around the heat roller beginning with the leading end of the sheet because van der Waals force and image force act on the space between the sheet and the heat roller.

Since the quantity of oil which is applied to the heat roller is 0.0063 mg/cm$^2$ or smaller, the sheet can furthermore easily be wound around the heat roller.

When the sheet allowed to pass through the first nipping portion is wound around the heat roller beginning with the leading end of the sheet, toner is melted at a stroke if toner exists at the leading end of the sheet. As a result, a further stable state of contact with the heat roller can be realized.

In a state in which the sheet is heated is maintained, the sheet is moved to the pressing portion (the second nipping portion) between the heat roller and the second pressing roller. Toner on the sheet is furthermore heated and pressed during the movement in the second nipping portion so that toner is completely fixed to the surface of the sheet.

The toner image fixed to the surface of the sheet is an image exhibiting excellent transparency because the quantity of oil applied to the heat roller is 0.0063 mg/cm$^2$ or smaller as described above.

As described above, the fixing apparatus is able to realize a state of fixation on the sheet free from nonuniformity in its entirety. Moreover, an image exhibiting excellent transparency can be obtained.

The fixing apparatus according to a still further aspect of the invention comprises a heat roller having a heat source therein; and first and second pressing rollers arranged to sequentially be pressed against the heat roller beginning with a more upstream pressing roller in a direction of rotations of the heat roller, wherein when an assumption is made that the quantity of oil which is applied to the heat roller is Y mg/cm$^2$, the hardness of the heat roller is Hh, the hardness of the first pressing roller is Hp1 and the ratio of hardness of the two rollers satisfies Hr1=Hh/Hp1, the quantity Y of oil is 0.0063 mg/cm$^2$ or smaller, and the heat roller and the first pressing roller are structured in such a-inanner that $Y<0.021\times Hr1-0.0147$ is satisfied.

That is, the quantity Y of oil applied to the heat roller is 0.0063 mg/cm$^2$ or smaller and the heat roller and the first pressing roller are structured in such a manner that the above-mentioned condition is satisfied. As a result, the sheet allowed to pass through the pressing portion (the first nipping portion) between the heat roller and the first pressing roller including its leading end can easily be wound around the heat roller. As a result, the leading end of the sheet is discharged from the first nipping portion in a state in which the leading end of the sheet is in contact with the heat roller or considerably closes the same regardless whether toner is placed on the sheet. Moreover, the sheet can easily be wound around the heat roller beginning with the leading end of the sheet because van der Waals force and image force act on the space between the sheet and the heat roller.

When the sheet allowed to pass through the first nipping portion is wound around the heat roller beginning with the leading end of the sheet, toner is melted at a stroke if toner exists at the leading end of the sheet. As a result, a further stable state of contact with the heat roller can be realized.

In a state in which the sheet is heated is maintained, the sheet is moved to the pressing portion (the second nipping portion) between the heat roller and the second pressing roller. Toner on the sheet is furthermore heated and pressed during the movement of the sheet in the second nipping portion so that toner is completely fixed to the surface of the sheet.

The toner image fixed to the surface of the sheet is an image exhibiting excellent transparency because the quantity of oil applied to the heat roller is 0.0063 mg/cm$^2$ or smaller as described above.

As described above, the fixing apparatus is able to realize a state of fixation on the sheet in its entirety. Moreover, an image exhibiting excellent transparency can be obtained.

If the quantity of oil is made to be 0.0063 mg/cm$^2$ or smaller as described above and the heat roller and the first pressing roller are structured in such a manner that the condition that $Y<0.021\times Hr1-0.0147$ is satisfied, the sheet allowed to pass through the first nipping portion is reliably wound around the heat roller beginning with its leading end. Then, the sheet is introduced into the pressing portion (the second nipping portion) between the heat roller and the second pressing roller. If no countermeasure is taken, there is apprehension that the sheet which must be separated from the heat roller after it has been allowed to pass through the second nipping portion is wound around the heat roller. Although a separation claw is required to separate the sheet allowed to pass through the second nipping portion from the heat roller, it is preferable that the separating operation is performed smoothly.

On the other hand, the fixing apparatus according to a still further aspect of the invention further comprises a second pressing roller, wherein when an assumption is made that the hardness of the second pressing roller is Hp2 and the ratio of hardness to that of the heat roller satisfies Hr2=Hh/Hp2, the heat roller and the second pressing roller are structured in such a manner that the following condition is satisfied: $Y \geqq 0.021 \times Hr2 - 0.0147$. Therefore, the following effect can be obtained.

If the heat roller and the second pressing roller are structured in such a manner that the foregoing condition is satisfied even in a case where the quantity Y of oil is 0.0063 $mg/cm^2$ or smaller, the sheet allowed to pass through the pressing portion (the second nipping portion) between the heat roller and the second pressing roller including its leading end is discharged from the second nipping portion in such a manner that the sheet is separated from the heat roller.

Therefore, the fixing apparatus described above enables the sheet allowed to pass through the second nipping portion to be separated from the heat roller even if a separating claw is omitted despite the structure that the quantity Y of oil is made to be 0.0063 $mg/cm^2$ or smaller and the heat roller and the first pressing roller are structured in such a manner that the condition that $Y < 0.021 \times Hr1 - 0.0147$ is satisfied.

That is, the fixing apparatus described above enables an image in a state of fixation free from nonuniformity on the sheet its entirety and having excellent transparency to be obtained. Moreover, the sheet can smoothly be separated from the heat roller.

The fixing apparatus according to a still further aspect of the inveniton has the structure that the pressing roller disposed in the upstream position is caused to have a function of heating toner and the pressing roller disposed at the downstream position is caused to have a function of strongly fixing toner to the recording medium by using heat and pressure. Thus, a high-duty fixing process can furthermore quickly and reliably be performed.

The fixing apparatuses according to a still further aspect of the invnetion has the heat preservation means interposed between two pressing rollers so that a decrease in temperature of the heat roller occurring attributable to contact with the recording medium is quickly restored. As a result, a high-duty fixing process can quickly be completed.

The fixing apparatuses according to a still further aspect of the invention enables the difference in the speed between the right side and the reverse side of the recording medium to be prevented. As a result, a high-duty fixing process can furthermore quickly and reliably be completed in such a manner that the recording medium is free from a crease.

BRIEF DESCRIPTION OF THE DRAWINGS

FIG. 5 is a table showing experimental data;

FIG. 6 is a table showing experimental data;

DETAILED DESCRIPTION OF PREFERRED EMBODIMENTS

Embodiments of the present invention will now be described with reference to the drawings.

Figure 1:
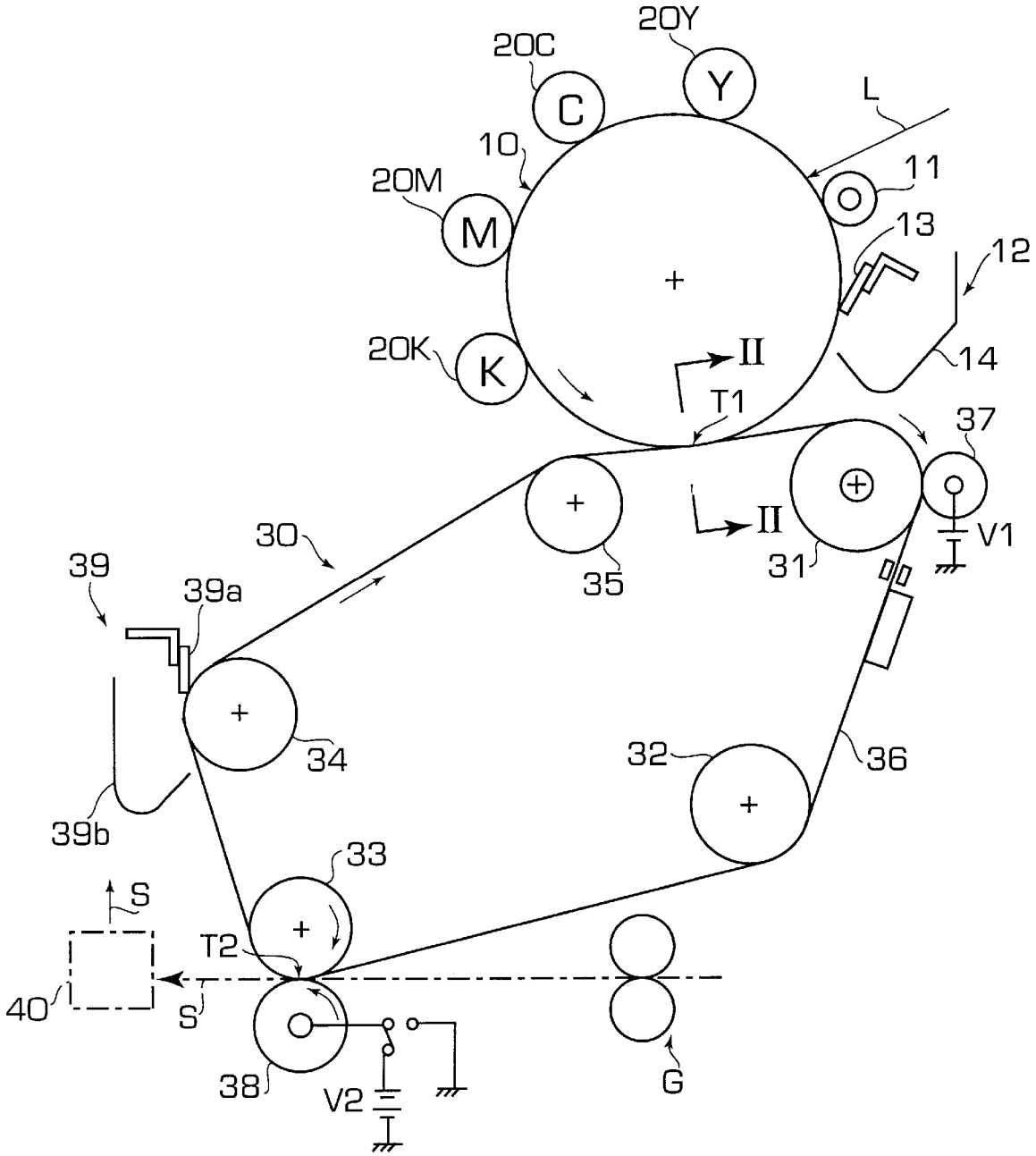
FIG. 1 is a schematic view showing an essential portion of an example of an image forming apparatus having an embodiment of a fixing apparatus according to the present invention.
Figure 2:
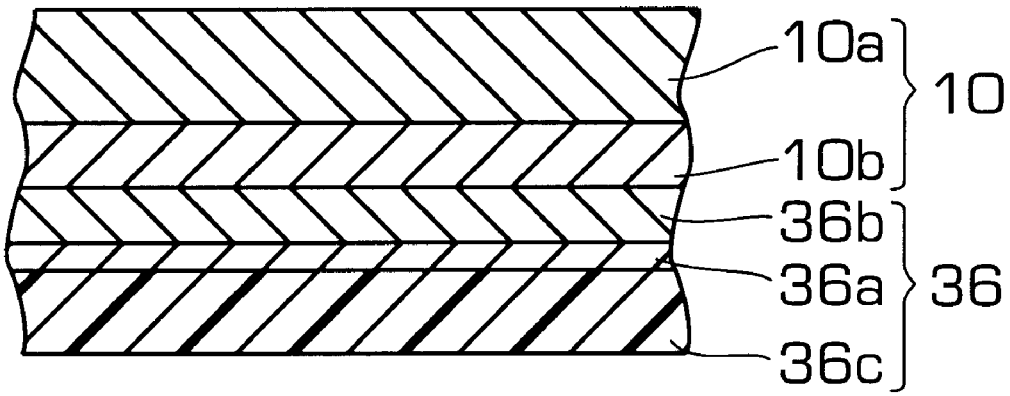
FIG. 2 is an enlarged end view of portion II shown in FIG. 1.
Figure 3:
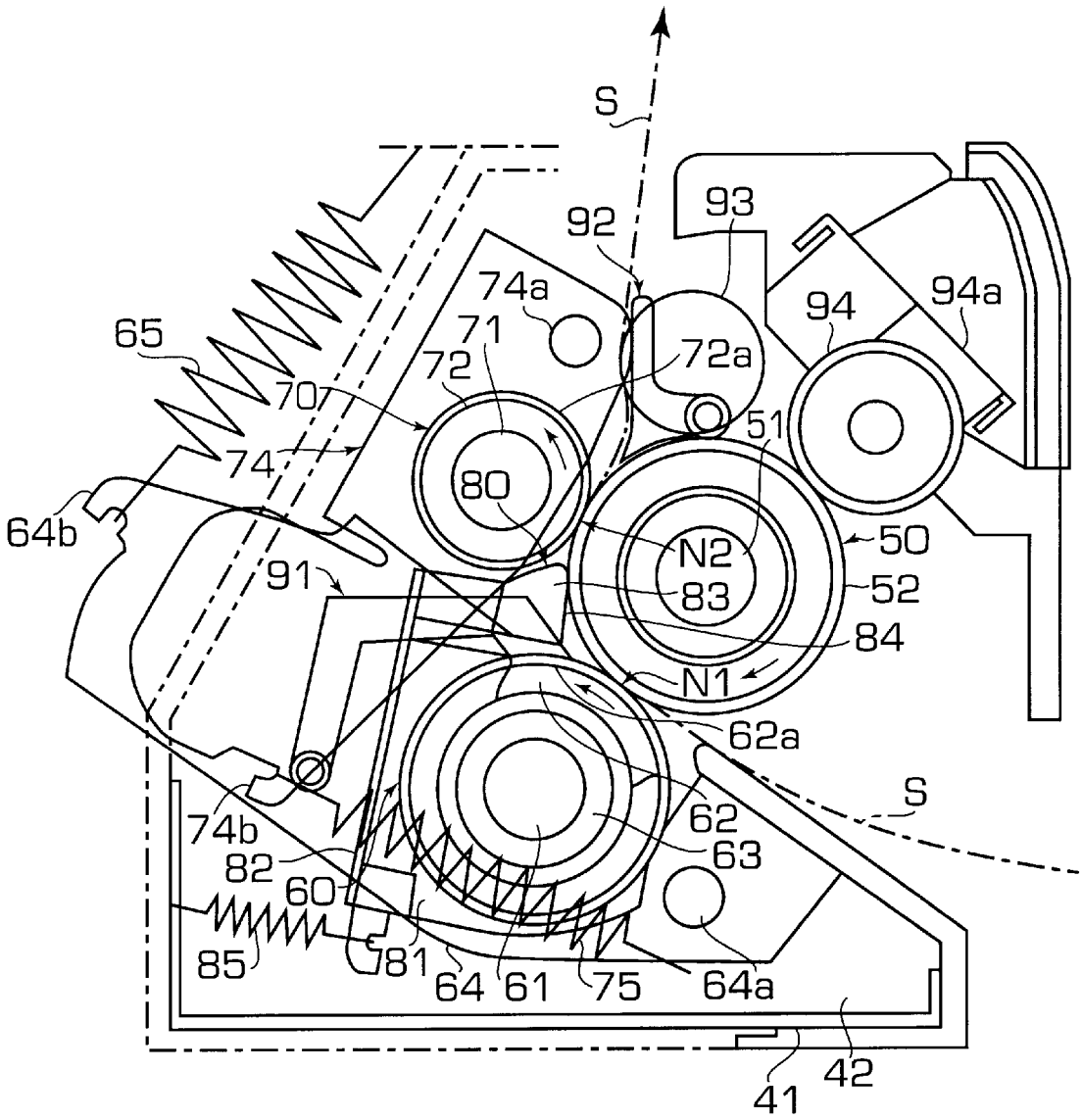
FIG. 3 is a partially-omitted side view showing an embodiment of the fixing apparatus according to the present invention.

FIG. 1 is a schematic view showing an essential portion of an image forming apparatus comprising a fixing apparatus according to the present invention. FIG. 2 is enlarged end view of portion II—II shown in FIG. 1. FIG. 3 is a partial side view showing an embodiment of the fixing apparatus according to the present invention.

Referring to FIGS. 1 and 2, the image forming apparatus will now be described.

The foregoing image forming apparatus is an apparatus which is capable of forming a full-color image by using developing units using toner in four colors are yellow, cyan, magenta and black.

Referring to FIG. 1, reference numeral 10 represents a photosensitive member which is rotated in a direction indicated by an arrow by an arbitrary drive means (not shown). In a direction of rotations of the photosensitive member 10, an electrifying roller 11 serving as an electrifying means, development rollers 20 (Y, M, C and K) serving as development means, an intermediate transfer unit 30 and a cleaning means 12 are disposed adjacent to the photosensitive member 10.

The photosensitive member 10 has a cylindrical conductive base 10*a* (see FIG. 2) and a photosensitive layer 10*b* formed on the surface of the conductive base 10*a*.

The electrifying roller 11 is arranged to be brought into contact with the outer surface of the photosensitive member 10 so that the foregoing outer surface is uniformly electrified. The outer surface of the photosensitive member 10, which has been uniformly electrified, is subjected to selective exposure L in accordance with required image information by an exposing unit (not shown). As a result of the exposure L, an electrostatic latent image is formed on the photosensitive member 10.

The electrostatic latent image is supplied with toner by the development roller 20 so as to be developed.

The development rollers 20 include a yellow development roller 20Y, a cyan development roller 20C, a magenta development roller 20M and a black development roller 20K. The development rollers 20Y, 20C, 20M and 20K are selectively brought into contact with the photosensitive member 10. When the contact is made, toner in any one of yellow, cyan, magenta and black color is supplied to the surface of the photosensitive member 10 so that the electrostatic latent image on the photosensitive member 10 is developed.

The developed toner image is transferred to the surface of an intermediate transfer belt 36 to be described later.

The cleaning means 12 has a cleaner blade 13 for scraping off toner left on the outer surface of the photosensitive member 10 and allowed to adhere to the same and a receiving portion 14 for receiving toner scraped by the cleaner blade 13.

The intermediate transfer unit 30 has a drive roller 31, four follower rollers 32, 33, 34 and 35 and an endless intermediate transfer belt 36 arranged among the foregoing rollers.

A gear (not shown) secured to an end of the drive roller 31 is engaged to a drive gear (not shown) of the photosensitive member 10 so that the drive roller 31 is rotated at substantially the same circumferential speed as that of the photosensitive member 10. As a result, the intermediate transfer belt 36 is circularly rotated in a direction indicated by an arrow shown in the drawing at substantially the same circumferential speed as that of the photosensitive member 10.

The follower roller 35 is disposed at a position at which the intermediate transfer belt 36 is pressed against the photosensitive member 10 because of the deadweight of the intermediate transfer belt 36 at a position between the follower roller 35 and the drive roller 31. A pressing portion between the photosensitive member 10 and the intermediate transfer belt 36 is formed into a primary transfer portion T1. The follower roller 35 is disposed adjacent to the primary transfer portion T1 at an upstream position in a direction of circulation of the intermediate transfer belt 36.

An electrode roller 37 is disposed in contact with the drive roller 31 through the intermediate transfer belt 36. Voltage (primary transfer voltage) V1 is, through the electrode roller 37, applied to a conductive layer 36*a* of the intermediate transfer belt 36 to be described later.

The follower roller 32 is a tension roller having an urging means (not shown) which urges the intermediate transfer belt 36 in a direction in which the intermediate transfer belt 36 is stretched taut.

The follower roller 33 is a backup roller which forms secondary transfer portion T2. A secondary transfer roller 38 is disposed opposite to the backup roller 33 through the intermediate transfer belt 36. The secondary transfer roller 38 can be brought into contact with the intermediate transfer belt 36 and separated from the same by a contact/separation-permission mechanism (not shown). The secondary transfer roller 38 is applied with secondary transfer voltage V2.

The follower roller 34 is a backup roller for the belt cleaner 39. The belt cleaner 39 has a cleaner blade 39*a* which is brought into contact with the intermediate transfer belt 36 so that toner left on and allowed to adhere to the outer surface of the intermediate transfer belt 36 is scraped off. In addition, the belt cleaner 39 has a receiving portion 39*b* for receiving toner scraped by the cleaner blade 39*a*. The belt cleaner 39 can be brought into contact with the intermediate transfer belt 36 and separated from the same by a contact/separation-permission mechanism (not shown).

As shown in FIG. 2, the intermediate transfer belt 36 is formed into a laminated belt having a conductive layer 36*a* and a resistance layer 36*b* formed on the conductive layer 36*a* and arranged to be pressed against the photosensitive member 10. The conductive layer 36*a* is formed on an insulation substrate 36*c* made of synthetic resin. The conductive layer 36*a* is applied with the primary transfer voltage V1 through the foregoing electrode roller 37. Note that the resistance layer 36*b* is removed in the form of an elongated shape at the side end of the intermediate transfer belt 36 so that the conductive layer 36*a* is exposed to the outside in the form of the elongated shape. The electrode roller 37 is brought into contact with the exposed portion.

In a period of the circular movement of the intermediate transfer belt 36, a toner image on the photosensitive member 10 is, in the primary transfer portion T1, transferred to the surface of the intermediate transfer belt 36. The toner image transferred to the surface of the intermediate transfer belt 36 is, in the secondary transfer portion T2, transferred to sheet S which is paper or the like supplied to a position between the intermediate transfer belt 36 and the secondary transfer roller 38.

The sheet S is fed from a feeding apparatus (not shown) so as to be supplied to the secondary transfer portion T2 at predetermined timing by a gate roller pair G.

The sheet S to which the toner image has been transferred in the secondary transfer portion T2 is allowed to pass through a fixing apparatus 40 to be described later. Thus, the toner image is fixed, and then the sheet S is moved to a predetermined position.

The operation of the above-mentioned image forming apparatus is performed as follows.

(i) When a printing instruction signal (an image forming signal) has been supplied from a host computer (a personal computer or the like) (not shown) to a control unit of the image forming apparatus, the photosensitive member 10, the development roller 20 and the intermediate transfer belt 36 are rotated.

(ii) The outer surface of the photosensitive member 10 is uniformly electrified by the electrifying roller 11.

(iii) The outer surface of the photosensitive member 10, which has uniformly been electrified, is subjected to selective exposure L in accordance with image information of a first color (for example, yellow) by the exposing unit (not shown). Thus, an electrostatic latent image for a yellow image is formed.

(iv) Only the development roller 20Y for the first color (for example, yellow) is brought into contact with the photosensitive member 10 so that the electrostatic latent image is developed. Thus, a toner image in the first color (for example, yellow) is formed on the photosensitive member 10.

(v) The intermediate transfer belt 36 is applied with primary transfer voltage V1 having a polarity opposite to that the polarity given to the toner. The toner image formed on the photosensitive member 10 is transferred to the surface of the intermediate transfer belt 36 in the primary transfer portion, that is, in the pressing portion T1 between the photosensitive member 10 and the intermediate transfer belt 36. At this time, the secondary transfer roller 38 and the belt cleaner 39 are separated from the intermediate transfer belt 36.

(vi) After toner left on the photosensitive member 10 has been removed by the cleaning means 12, destaticizing light emitted from a destaticizing means (not shown) destaticizes the photosensitive member 10.

(vii) The foregoing operations (ii) to (vi) are repeated as necessary. That is, the operations for the second, third and fourth colors are repeated in accordance with the contents of the printing instruction signal. As a result, toner images corresponding to the content of the printing instruction signal are stacked on the intermediate transfer belt 36 so that a toner image is formed on the intermediate transfer belt 36.

(viii) The sheet S is supplied at predetermined timing. Immediately before the leading end of the sheet S reaches the secondary transfer portion T2 or after it has reached the same (that is, at timing at which the toner image on the intermediate transfer belt 36 is transferred to a required position on the surface of the sheet S), the secondary transfer roller 38 is pressed against the intermediate transfer belt 36. Moreover, the secondary transfer voltage V2 is applied so that the toner image (basically, a full-color image formed by stacking toner images in four colors) on the intermediate transfer belt 36 is transferred to the surface of the sheet S. The belt cleaner 39 is brought into contact with the intermediate transfer belt 36 so that toner left on the intermediate transfer belt 36 after the secondary transfer operation has been performed is removed.

(ix) Since the sheet S passes through the fixing apparatus 40, the toner image is fixed to the surface of the sheet S. Then, the sheet S is moved to a predetermined position (for example, to a position outside the apparatus).

The above-mentioned image forming apparatus is arranged in such a manner that the sheet S to which a full-color toner image formed by stacking toner images in four colors has been transferred is supplied to the fixing apparatus 40.

The fixing apparatus 40 will now be described.

Referring to FIG. 3, reference numeral 41 represents a frame for the fixing apparatus, 50 represents a heat roller, 60 represents a first pressing roller and 70 represents a second pressing roller.

The heat roller 50 has a heat source 51 in the central portion thereof and an elastic layer 52 on the surface thereof. Therefore, the heat roller 50 is formed into an elastic roller. The heat roller 50 is rotatively supported by side plates 42 of a frame 41 in such a manner that the heat roller 50 cannot be moved in the axial and radial directions. The heat roller 50 can be rotated in a direction indicated by an arrow shown in the drawing by a drive means (not shown).

The first pressing roller 60 has a metal shaft 61, a roller portion 62 secured to the shaft 61 and an elastic layer 62*a* formed on the surface of the roller portion 62. Therefore, the first pressing roller 60 is formed into an elastic roller. The two ends of the shaft 61 of the first pressing roller 60 are rotatively supported by levers 64 (one of which is illustrated) through bearings 63. An end of the levers 64 is, by dint of a shaft 64*a*, rotatively supported by side plates 42. A tension spring 65 serving as a pressing means is disposed between another end 64b and the frame 41. Since the shaft 61 of the first pressing roller 60 is supported by an intermediate portion of the levers 64, the tension spring 65 serves as the pressing means. Therefore, the first pressing roller 60 is pressed against the heat roller 50 by dint of the tension spring 65 so that the first pressing roller 60 is rotated to follow the heat roller 50.

The second pressing roller 70 has a metal shaft 71, a roller portion 72 secured to the shaft 71 and an elastic layer 72*a* formed on the surface of the roller portion 72. Therefore, the second pressing roller 70 is formed into an elastic roller. The two ends of the shaft 71 of the second pressing roller 70 are rotatively supported by levers 74 (one of which is illustrated) through a bearing (not shown). An end of the lever 74 is rotatively supported by the side plates 42 of the frame 41 by dint of a shaft 74*a*. A tension spring 75 serving as a pressing means is disposed between the end 74*b* and the frame 41. Since the shaft 71 of the second pressing roller 70 is supported by an intermediate position of the lever 74, the tension spring 75 serves as a pressing means. Therefore, the second pressing roller 70 is pressed against the heat roller 50 by dint of the tension spring 75 so as to be rotated to follow the heat roller 50. The second pressing roller 70 is pressed against the heat roller 50 at a position more downstream from the first pressing roller 60 in the direction of rotations of the heat roller 50.

Assuming that the hardness of each of the heat roller 50, the first pressing roller 60 and the second pressing roller 70 are Hh, Hp1 and Hp2, the ratio of hardness of the heat roller 50 and that of the first pressing roller 60 satisfies Hr1=Hh/Hp1 and the ratio of the hardness of the heat roller 50 and that of the second pressing roller 70 satisfies Hr2=Hh/Hp2, the following conditions are satisfied:

$Hr1 \geqq 1.5$ $Hr2 \leqq 0.7$

Note that this embodiment has a guide member 80 disposed between the first pressing roller 60 and the second pressing roller 70. Moreover, a first separating claw 91 is disposed on the outer surface of the first pressing roller 60. A second separating claw 92 for separating the sheet from the heat roller 50 at a position downstream from the second pressing roller 70 is disposed on the outer surface of the heat roller 50. At a more downstream position, there is disposed an oil-coating roller 94 for smoothing the separation of the sheet. The guide member 80, the first separating claw 91, the second separating claw 92 and the oil-coating roller 94 may be omitted because of a reason to be described later.

Assuming that the hardness of the heat roller 50 and the first pressing roller 60 are Hh and Hp and the ratio of hardness of the two rollers satisfies Hr=Hh/Hp, they are structured in such a manner that the following condition is satisfied:

$Hr>1$.

That is, the structures are arranged in such a manner that the hardness Hp of the first pressing roller 60 is smaller than the hardness Hh of the heat roller 50.

The oil-coating roller 94 for applying oil to the surface of the heat roller 50 is disposed on the outer surface of the heat roller 50 in order to smoothly separate of the sheet S from the heat roller 50. The oil-coating roller 94 is rotatively supported by a support member 94*a* joined to the frame 41 so as to be pressed against the heat roller 50 by an urging means (not shown). Thus, the oil-coating roller 94 is rotated to follow the heat roller 50. The oil-coating roller 94 applies surface lubricant, such as silicon oil, to the surface of the heat roller 50 in a quantity of 0.0063 $mg/cm^2$ or smaller (including 0 $mg/cm^2$, that is, no application).

If the quantity of oil which is applied to the heat roller 50 is relatively small, the sheet S can easily be wound around the heat roller 50. Thus, there is apprehension that the sheet S which passes through the pressing portion between the heat roller 50 and the second pressing roller 70 will be separated from the heat roller 50 and will become wound around the heat roller 50.

Accordingly, this embodiment has the structure that the second separating claw 92 for separating the sheet S from the heat roller 50 is disposed on the outer surface of the heat roller 50, the second separating claw 92 being disposed at a downstream position from the second pressing roller 70.

In this embodiment, the guide member 80 is disposed between the first pressing roller 60 and the second pressing roller 70 and the first separating claw 91 is disposed on the outer surface of the first pressing roller 60. The guide member 80 and the first separating claw 91 may be omitted from the structure because of a reason to be described later.

The above-mentioned fixing apparatus is disposed in the rear of the secondary transfer portion T2 in the image forming apparatus. The operation will now be described.

When the operation of the image forming apparatus has been started, the heat roller 50 is heated by the heat source 51. The first and second pressing rollers 60 and 70 are pressed against the heat roller 50 so that the heat roller 50 is rotated in a direction indicated by an arrow shown in the drawing. As a result, the first and second pressing rollers 60 and 70 are rotated to follow the heat roller 50.

The sheet S in a state in which the toner image has been transferred to the upper surface of the sheet S is supplied to a position between the heat roller 50 and the first pressing roller 60.

The thus-supplied sheet S is wound around the heat roller 50 while the sheet S is moved by the pressing portion (the first nipping portion) N1 between the heat roller 50 and the first pressing roller 60. Thus, toner on the sheet S is heated and pressed so as to primarily be fixed.

Then, the sheet S is moved to the pressing portion (the second nipping portion) N2 between the heat roller 50 and the second pressing roller 70 in such a manner that the state in which the sheet S is heated is maintained. Toner is furthermore heated and pressed while the sheet S is moved by the second nipping portion N2 so that toner is completely fixed.

Then, the sheet S to which the toner image has been fixed is separated from the heat roller 50, and then moved to a predetermined position through a curl-correction roller 93.

The oil-coating roller 94 for applying oil to the surface of the heat roller 50 is disposed on the outer surface of the heat roller 50 in order to easily separate the sheet S allowed to pass through the pressing portion between the heat roller 50 and the second pressing roller 70 from the heat roller 50. The oil-coating roller 94 is rotatively supported by the support member 94*a* joined to the frame 41 so as to be pressed against the heat roller 50 by the urging means (not shown) so as to be rotated to follow the heat roller 50. The oil-coating roller 94 applies surface lubricant, such as silicon oil, to the surface of the heat roller 50 in a quantity of 0.0063 $mg/cm^2$ or smaller (including 0 $mg/cm^2$, that is, no application. If oil application is not performed, the oil-coating roller 94 may be omitted from the structure.

Assuming that the hardness of each of the heat roller 50, the first pressing roller 60 and the second pressing roller 70 are Hh, Hp1 and Hp2, the ratio of the hardness of the heat roller 50 and that of the first pressing roller 60 satisfies Hr1=Hh/Hp1, the ratio of the hardness of the heat roller 50 and that of the second pressing roller 70 satisfies Hr2=Hh/Hp2 and the quantity of oil which is applied by the oil-coating roller 94 is Y, they are structured in such a manner that the following conditions are satisfied:

$Y<0.021\times Hr1-0.0147$ $Y\geqq 0.021\times Hr2-0.0147$

In this embodiment, the guide member 80 is disposed between the first pressing roller 60 and the second pressing roller 70, the first separating claw 91 is disposed on the outer surface of the first pressing roller 60 and the second separating claw 92 is disposed on the outer surface of the heat roller 50 in order to separate the sheet from the heat roller 50 at the position in the downstream direction from the second pressing roller 70. The guide member 80, the first separating claw 91 and the second separating claw 92 may be omitted from a reason to be described later.

The fixing apparatus according to this embodiment attains the following effect.

Figure 4A:
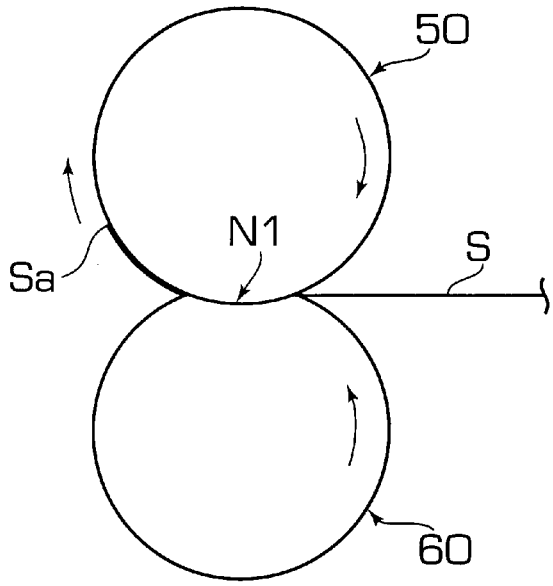
FIGS. 4 (*a*) and 4 (*b*) are diagrams showing the operation of an embodiment of the fixing apparatus.
Figure 4B:
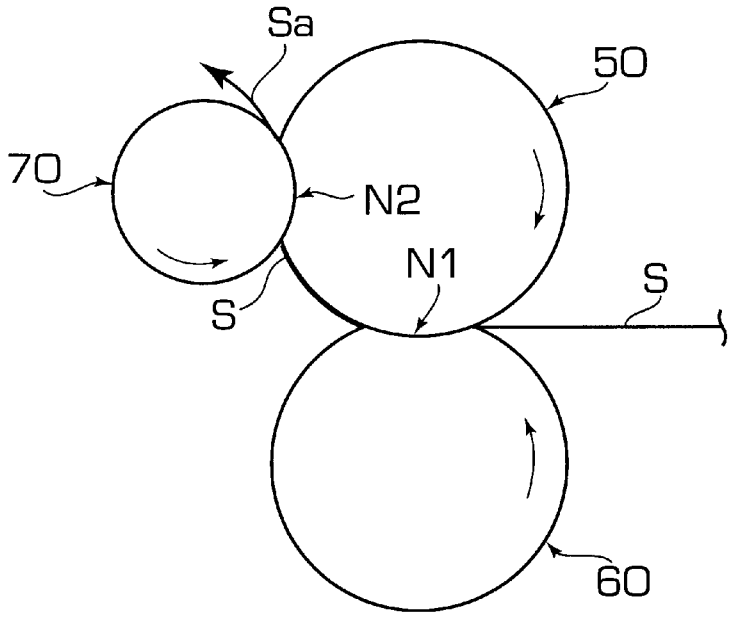

(a) When an assumption is made that the hardness of the heat roller 50 is Hh, the hardness of the first pressing roller is Hp1 and the ratio of the hardness of the two rollers satisfies Hr1=Hh/Hp1, the heat roller 50 and the first pressing roller 60 are structured in such a manner that the following condition is satisfied: $Hr1\geqq 1.5$. Therefore, the foregoing apparatus attains the following effect:

If the ratio Hr1=Hh/Hp1 of the hardness of the heat roller 50 and the first pressing roller 60 is not smaller than 1.5, the pressing portion (a first nipping portion) N1 between the heat roller 50 and the first pressing roller 60 has a shape that the first pressing roller 60 portion is considerably recessed when the shape is viewed from the axial direction of the roller, as schematically shown in FIG. 4 (*a*). Thus, the sheet S allowed to pass through the first nipping portion N1 and including the leading end Sa thereof is greatly deformed in a direction in which the sheet S is wound around the heat roller 50. As a result, the leading end Sa of the sheet S is discharged from the first nipping portion N1 in a state in which the leading end Sa of the sheet S is in contact with the heat roller 50 or considerably closes the same regardless whether toner is placed on the sheet S. Moreover, the sheet S is reliably wound around the heat roller 50 beginning with the leading end Sa of the sheet S because van der Waals force and image force act on the space between the sheet S and the heat roller 50. That is, even if oil is supplied to the surface of the heat roller 50 by the oil-coating roller 94, the sheet S is reliably wound around the heat roller 50 beginning with the leading end Sa of the sheet S. Therefore, if the guide member 80 and the first separating claw 91 are omitted, the sheet S is reliably wound around the heat roller 50 beginning with the leading end Sa of the sheet S.

When the sheet S allowed to pass through the first nipping portion N1 is reliably wound around the heat roller 50 beginning with the leading end Sa of the sheet S, toner is melted at a stroke if toner exists at the leading end Sa of the sheet S. As a result; a further stable state of contact with the heat roller 50 can be realized.

Therefore, the fixing apparatus according to this embodiment is able to realize a state of fixation in which the sheet S is free from nonuniformity in its entirety.

(b) If the ratio Hr1 of the hardness between the heat roller 50 and the first pressing roller 60 is made to be 1.5 or higher as described above, the sheet S allowed to pass through the first nipping portion N1 is reliably wound around the heat roller 50 beginning with its leading end Sa. Then, the sheet S is introduced into the pressing portion (a second nipping portion) N2 between the heat roller 50 and the second pressing roller 70. If no countermeasure is taken, there is apprehension that the sheet S which must be separated from the heat roller 50 after it has been allowed to pass through the second nipping portion N2 is wound around the heat roller 50. Although a separation claw 92 is required to separate the sheet S allowed to pass through the second nipping portion N2 from the heat roller 50, it is preferable that the separating operation is performed smoothly.

The fixing apparatus according to this embodiment has a structure that when an assumption is made that the hardness of the second pressing roller 70 is Hp2 and the ratio of hardness to that of the heat roller 50 satisfies Hr2=Hh/Hp2, the heat roller 50 and the second pressing roller 70 are structured in such a manner that the following condition is satisfied: $Hr2\leqq 0.7$. Therefore, the following effect can be obtained.

If the ratio Hr2=Hh/Hp2 of the hardness of the heat roller 50 and the second pressing roller 70 is not more than 0.7, the pressing portion (a second nipping portion) N2 between the heat roller 50 and the second pressing roller 70 has a shape that the heat roller 50 portion is, as schematically shown in FIG. 4 (*b*), considerably recessed when the shape is viewed from the axial direction of the roller. Thus, the sheet S allowed to pass through the second nipping portion N2 and including the leading end Sa thereof is deformed in a direction in which the sheet S is not wound around the heat roller 50. Then, the leading end Sa of the sheet S is discharged from the second nipping portion N2.

Therefore, the fixing apparatus according to this embodiment enables the sheet S allowed to pass through the second nipping portion N2 to be separated from the heat roller 50 even if the separating claw 92 is omitted despite the structure that the ratio Hr1 of the hardness between the heat roller 50 and the first pressing roller 60 is 1.5 or higher.

That is, the fixing apparatus according to this embodiment is able to realize a state of fixation free from any nonuniformity in its entirety. Moreover, the sheet S can smoothly be separated from the heat roller 50.

(c) If a stable color development characteristic is realized and excellent transparency is obtained with a sheet for an OHP by an apparatus, such as the image forming apparatus shown in FIG. 1, in which a multi-color toner image collectively transferred to the surface of the sheet S is collectively fixed, multilayered toner must sufficiently be melted and mixed before toner is fixed.

However, the fixing apparatus according to this embodiment has the above-mentioned structure that the toner image on the sheet S is primarily fixed by the pressing portion (the first nipping portion) N1 between the heat roller 50 and the first pressing roller 60. Then, the sheet S is reliably wound around the heat roller 50 as described above. Therefore, toner is continuously heated, and while the state of heating is maintained, toner is furthermore heated and pressed by the pressing portion (the second nipping portion) N2 between the heat roller 50 and the second pressing roller 70 so as to secondarily be fixed. Thus, even if toner is formed into a multi-layer structure, toner can sufficiently be melted, mixed and fixed. Therefore, a stable color developing characteristic can be obtained from a color toner image and satisfactory transparency can be realized with a sheet for an OHP.

If the above-mentioned structure in which toner in the form of the multi-layered structure is supplied with a sufficiently large heating value so as to satisfactorily be melted is employed, the adhesiveness of toner causes the sheet S to easily be wound around the heat roller 50. However, the fixing apparatus according to this embodiment is able to smoothly separate the sheet S from the heat roller 50 because of the above-mentioned reason.

Although the invention has been described in its preferred form, it is understood that the present disclosure of the preferred form can be changed without departing from the spirit and the scope of the invention.

Although the structure according to this embodiment has the structure that only the first and second pressing rollers 60 and 70 are pressed against one heat roller 50, the present invention may be applied to a structure in which a guide pressing roller is disposed between the first pressing roller 60 and the second pressing roller 70.

(d) Since the hardness Hp of the first pressing roller 60 is made to be lower than the hardness Hh of the heat roller 50 and the quantity of oil which is applied to the he at roller 50 is 0.0063 mg/cm$^2$ or smaller, the foregoing apparatus attains the following effect.

Figure 9A:
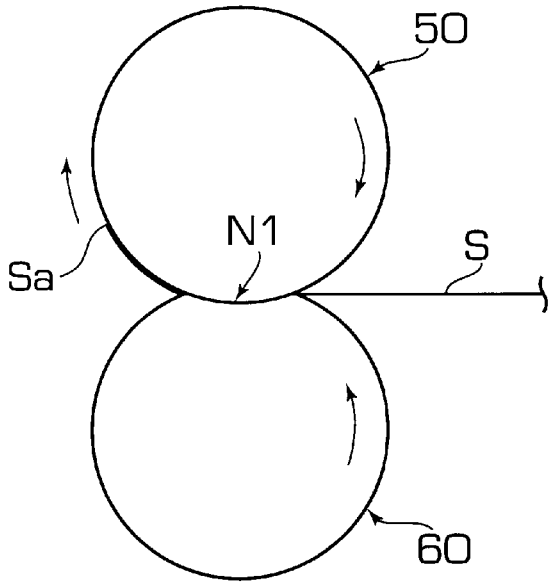
FIGS. 9 (*a*) and 9 (*b*) are diagrams showing the operation of the present invention.
Figure 9B:
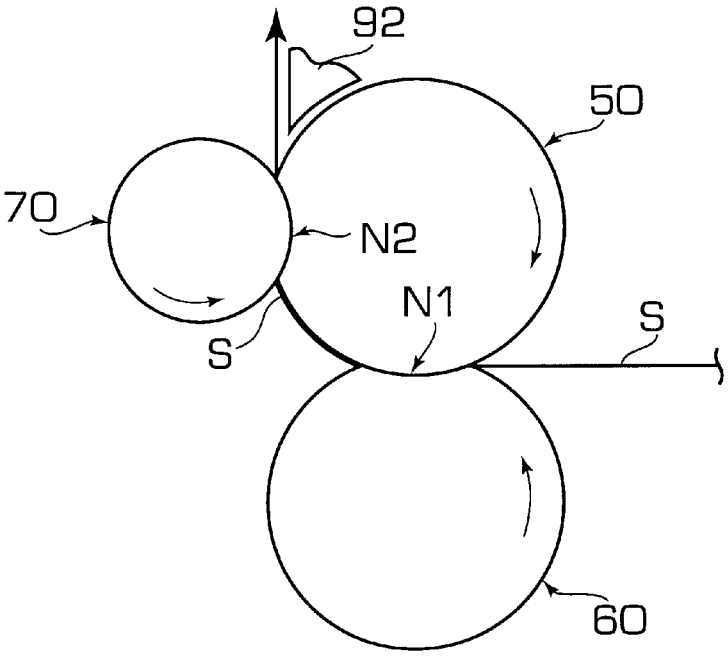
Figure 10:
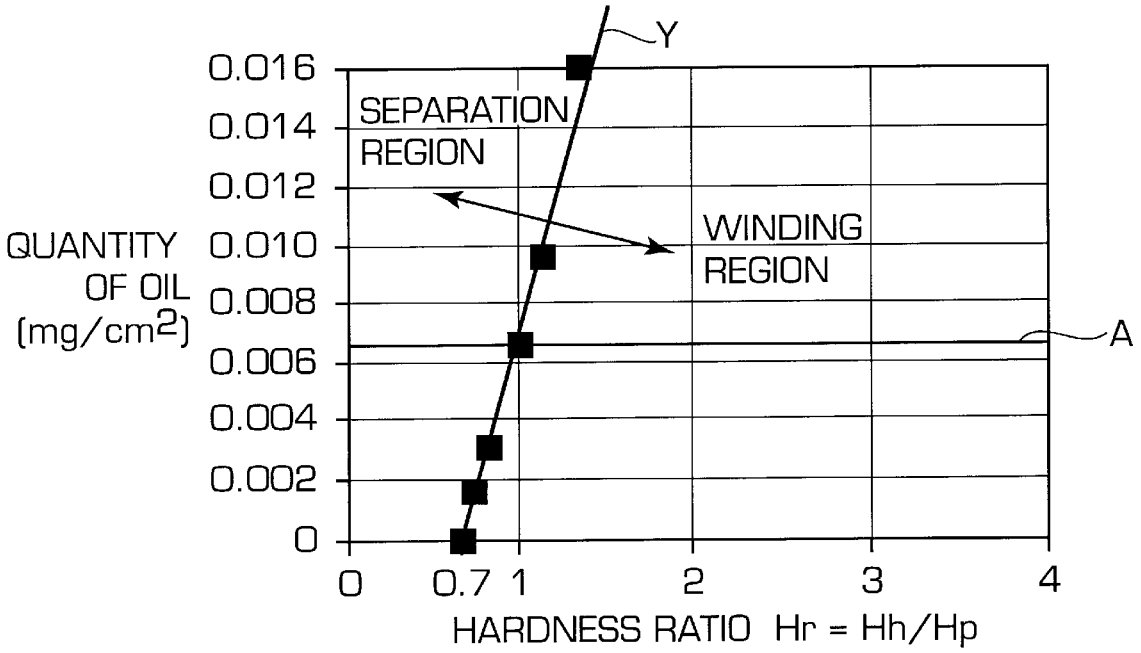
FIG. 10 is a graph showing experimental data.

If the hardness Hp of the first pressing roller 60 is smaller than the hardness Hh of the heat roller 50, the pressing portion (a first nipping portion) N1 between the heat roller 50 and the first pressing roller 60 has a shape that the first pressing roller 60 portion is considerably recessed when the shape is viewed from the axial direction of the roller, as schematically shown in FIG. 9 (*a*). Thus, the sheet S allowed to pass through the first nipping portion N1 and including the leading end Sa thereof is deformed in a direction in which the sheet S is wound around the heat roller 50. As a result, the leading end Sa of the sheet S is discharged from the first nipping portion N1 in a state in which the leading end Sa of the sheet S is in contact with the heat roller 50 or considerably closes the same regardless whether toner is placed on the sheet S. Moreover, the sheet S can easily be wound around the heat roller 50 beginning with the leading end Sa of the sheet S because van der Waals force and image force act on the space between the sheet S and the heat roller 50.

Since the quantity of oil which is applied to the heat roller 50 is 0.0063 mg/cm$^2$ or smaller, the sheet S can furthermore easily be wound around the heat roller 50.

When the sheet S allowed to pass through the first nipping portion N1 is wound around the heat roller 50 beginning with the leading end Sa of the sheet S, toner is melted at a stroke if toner exists at the leading end Sa of the sheet S. As a result, a further stable state of contact with the heat roller 50 can be realized.

In a state in which the sheet S is heated is maintained, the sheet S is moved to the pressing portion (the second nipping portion N2) between the heat roller 50 and the second pressing roller 70. Toner on the sheet S is furthermore heated and pressed during the movement of the sheet S in the second nipping portion N2 so that toner is completely fixed to the surface of the sheet S.

The toner image fixed to the surface of the sheet S is an image exhibiting excellent transparency because the quantity of oil applied to the heat roller 50 is 0.0063 mg/cm$^2$ or smaller as described above.

As described above, the fixing apparatus according to this embodiment is able to realize a state of fixation on the sheet S in its entirety. Moreover, an image exhibiting excellent transparency can be obtained.

In a case where the sheet is a sheet for an OHP and toner images in a plurality of colors stacked on the sheet for an OHP are melted and fixed to obtain a color image, stacked toner in the plural colors must sufficiently be heated, melted and mixed to realize transparency. The fixing apparatus according to this embodiment is able to realize an image exhibiting satisfactory transparency.

If the quantity of oil which is applied to the heat roller 50 is relatively small, the sheet S can easily be wound around the heat roller 50 as described above. Therefore, the sheet S allowed to pass through the second nipping portion N2 between the heat roller 50 and the second pressing roller 70 cannot be separated from the heat roller 50 and the sheet S can easily be wound around the heat roller 50. Since this embodiment has the structure that the second separating claw 92 for separating the sheet S from the heat roller 50 is disposed at the downstream position from the second pressing roller 70, the sheet S allowed to pass through the second nipping portion N2 between the heat roller 50 and the second pressing roller 70 can reliably be separated from the heat roller 50.

(e) If a stable color development characteristic is realized and excellent transparency is obtained with a sheet for an OHP by an apparatus, such as the image forming apparatus shown in FIG. 1, in which a multi-color toner image collectively transferred to the surface of the sheet S is collectively fixed, multilayered toner must sufficiently be melted and mixed before toner is fixed.

However, the fixing apparatus according to this embodiment has the above-mentioned structure that the toner image on the sheet S is primarily fixed by the pressing portion (the first nipping portion) N1 between the heat roller 50 and the first pressing roller 60. Then, the sheet S is wound around the heat roller 50 as described above so that toner is continuously heated. While the heating state is maintained, toner is furthermore heated and pressed by the pressing portion (the second nipping portion) N2 between the heat roller 50 and the second pressing roller 70 so as to secondarily be fixed. Thus, even if toner is formed into a multi-layer structure, toner can sufficiently be melted, mixed and fixed.

Therefore, a stable color developing characteristic can be obtained from a color toner image and satisfactory transparency can be realized with a sheet for an OHP.

Since the quantity of oil which is applied to the heat roller 50 is 0.0063 mg/cm$^2$ or smaller, an excellent-color image can be formed on a sheet for an OHP.

Although the invention has been described in its preferred form, it is understood that the present disclosure of the preferred-form can be changed without departing from the spirit and the scope of the invention.

Although the structure according to this embodiment has the structure that only the first and second pressing rollers 60 and 70 are pressed against one heat roller 50, the present invention may be applied to a structure in which a guide pressing roller is disposed between the first pressing roller 60 and the second pressing roller 70. Although the elastic roller is employed in the above-mentioned embodiment, the present invention may be applied to a structure in which a rigid roller is employed.

(f) When an assumption is made that the quantity of oil which is applied to the heat roller is Y mg/cm$^2$, the hardness of the heat roller 50 is Hh, the hardness of the first pressing roller 60 is Hp1 and the ratio of hardness of the two rollers satisfies Hr1=Hh/Hp1, the quantity Y of oil is 0.0063 mg/cm$^2$ or smaller, and the heat roller 50 and the first pressing roller 60 are structured in such a manner that the following condition is satisfied:

$Y<0.021\times Hr1-0.0147$ is satisfied.

Therefore, the following effect can be obtained.

That is, the quantity Y of oil applied to the heat roller 60 is 0.0063 mg/cm$^2$ or smaller and the heat roller 50 and the first pressing roller 60 are structured in such a manner that the above-mentioned condition is satisfied. Thus, as schematically shown in FIG. 4 (*a*), the sheet S allowed to pass through the pressing portion (the first nipping portion) N1 between the heat roller 50 and the first pressing roller 60 including its leading end Sa can easily be wound around the heat roller 50. As a result, the leading end Sa of the sheet S is discharged from the first nipping portion N1 in a state in which the leading end Sa of the sheet S is in contact with the heat roller 50 or considerably closes the same regardless whether toner is placed on the sheet S. Moreover, the sheet S can easily be wound around the heat roller 50 beginning with the leading end Sa of the sheet S because van der Waals force and image force act on the space between the sheet S and the heat roller 50.

When the sheet S allowed to pass through the first nipping portion N1 is wound around the heat roller 50 beginning with the leading end Sa of the sheet S, toner is melted at a stroke if toner exists at the leading end Sa of the sheet S. As a result, a further stable state of contact with the heat roller 50 can be realized.

In a state in which the sheet S is heated is maintained, the sheet S is moved to the pressing portion (the second nipping portion) N2 between the heat roller 50 and the second pressing roller 70. Toner on the sheet S is furthermore heated and pressed during the movement in the second nipping portion N2 so that toner is completely fixed to the surface of the sheet S.

The toner image fixed to the surface of the sheet S is an image exhibiting excellent transparency because the quantity of oil applied to the heat roller 50 is 0.0063 mg/cm$^2$ or smaller as described above.

As described above, the fixing apparatus according to this embodiment is able to realize a state of fixation free from nonuniformity on the sheet in its entirety. Moreover, an image exhibiting excellent transparency can be obtained.

In a case where the sheet is a sheet for an OHP and toner images in a plurality of colors stacked on the sheet for an OHP are melted and fixed to obtain a color image, stacked toner in the plural colors must sufficiently be heated, melted and mixed to realize transparency. The fixing apparatus according to this embodiment is able to realize an image exhibiting satisfactory transparency.

(g) If the quantity of oil is made to be 0.0063 mglcm$^2$ or smaller as described above and the heat roller 50 and the first pressing roller 60 are structured in such a manner that the condition that $Y<0.021\times Hr1-0.0147$ is satisfied, the sheet S allowed to pass through the first nipping portion N1 is wound around the heat roller 50 beginning with its leading end Sa. Then, the sheet S is introduced into the pressing portion (the second nipping portion) N2 between the heat roller 50 and the second pressing roller 70. If no countermeasure is taken, there is apprehension that the sheet S which must be separated from the heat roller 50 after it has been allowed to pass through the second nipping portion N2 is wound around the heat roller 50. Although the separation claw 92 is required to separate the sheet S allowed to pass through the second nipping portion N2 from the heat roller 50, it is preferable that the separating operation is performed smoothly.

On the other hand, the fixing apparatus according to this embodiment has a structure that when an assumption is made that the hardness of the second pressing roller 70 is Hp2 and the ratio of hardness to that of the heat roller 50 satisfies Hr2=Hh/Hp2, the heat roller 50 and the second pressing roller 70 are structured in such a manner that the following condition is satisfied:

$Y\geqq 0.021\times Hr2-0.0147$.

Therefore, the following effect can be obtained.

If the heat roller 50 and the second pressing roller 70 are structured in such a manner that the foregoing condition is satisfied even in a case where the quantity Y of oil is 0.0063 mg/cm$^2$ or smaller, the sheet S allowed to pass through the pressing portion (the second nipping portion) N2 between the heat roller 50 and the second pressing roller 70 including its leading end Sa is discharged from the second nipping portion N2 in such a manner that the sheet S is separated from the heat roller 50, as schematically shown in FIG. 4 (*b*).

Therefore, the fixing apparatus according to this embodiment even having the structure that the quantity Y of oil is 0.0063 mg/cm$^2$ or smaller and the heat roller 50 and the first pressing roller 60 are formed in such a manner that $Y<0.021\times Hr1-0.0147$ is satisfied is able to eliminate the necessity of providing the second separating claw 92 to separate the sheet S allowed to pass through the second nipping portion N2 from the heat roller 50.

That is, the fixing apparatus according to this embodiment is able to realize a state of fixation free from nonuniformity in its entirety. Moreover, the sheet S can smoothly be separated from the heat roller 50.

(h) If a stable color development characteristic is realized and excellent transparency is obtained with a sheet for an OHP by an apparatus, such as the image forming apparatus shown in FIG. 1, in which a multi-color toner image collectively transferred to the surface of the sheet S is collectively fixed, multilayered toner must sufficiently be melted and mixed before toner is fixed.

However, the fixing apparatus according to this embodiment has the above-mentioned structure that the toner image on the sheet S is primarily fixed by the pressing portion (the first nipping portion)-N1 between the heat roller 50 and the first pressing roller 60. Then, the sheet S is wound around the heat roller 50 as described above. Therefore, toner is continuously heated, and while the state of heating is maintained, toner is furthermore heated and pressed by the pressing portion (the second nipping portion) N2 between the heat roller 50 and the second pressing roller 70 so as to secondarily be fixed. Thus, even if toner is formed into a multi-layer structure, toner can sufficiently be melted and mixed and fixed. Therefore, a stable color developing characteristic can be obtained from a color toner image and satisfactory transparency can be realized with a sheet for an OHP.

If the, above-mentioned structure in which toner in the form of the multi-layered structure is supplied with a sufficiently large heating value so as to satisfactorily be melted is employed and quantity Y of oil is 0.0063 mg/cm$^2$ or smaller, the adhesiveness of toner causes the sheet S to easily be wound around the heat roller 50. However, the fixing apparatus according to this embodiment is able to smoothly separate the sheet S from the heat roller 50 because of the above-mentioned reason.

EXAMPLE

A plurality of heat rollers having different hardness values and a plurality of pressing rollers having different hardness values were combined variously. Then, the pressing roller was brought into contact with the heat roller in such a manner that the quantity of oil applied to the heat roller was changed. Thus, winding of a sheet having a toner image around the heat roller was confirmed. Results were shown in tables shown in FIGS. 5 and 6. Note that the heat roller had a structure that a silicon rubber layer or a fluorine rubber layer was formed on the surface of an aluminum pipe. The hardness of the heat roller was changed by changing the thickness of the rubber layer. The pressing roller had a structure that a silicon rubber layer or a fluorine rubber layer was formed on a steel pipe. The hardness of the roller was changed by changing the thickness of the rubber layer. The pressing roller was a roller which may be employed as either of the first pressing roller and the second pressing roller. Therefore, the hardness ratio Hr=Hh/Hp of the heat roller and the pressing roller shown in the table may be used as either of the hardness ratio Hr1 (=Hh/Hp1) of the heat roller and the first pressing roller and the hardness ratio Hr2 (=Hh/Hp2) of the heat roller and the second pressing roller. In the table, "HAZE" indicates the haze (conversely, the transparency) of a toner image fixed to the surface of the sheet.

In accordance with results of the experiments, results of A to F in the table shown in FIG. 5 were plotted, and then connected by a straight line. Thus, the relationship between the quantity of applied oil and whether or not sheet was wound was shown in a graph shown in FIG. 7. Note that a portion to the right of line Y was a winding region in which the sheet was wound and a portion to the left was a separation region in which no winding took place.

Figure 7:
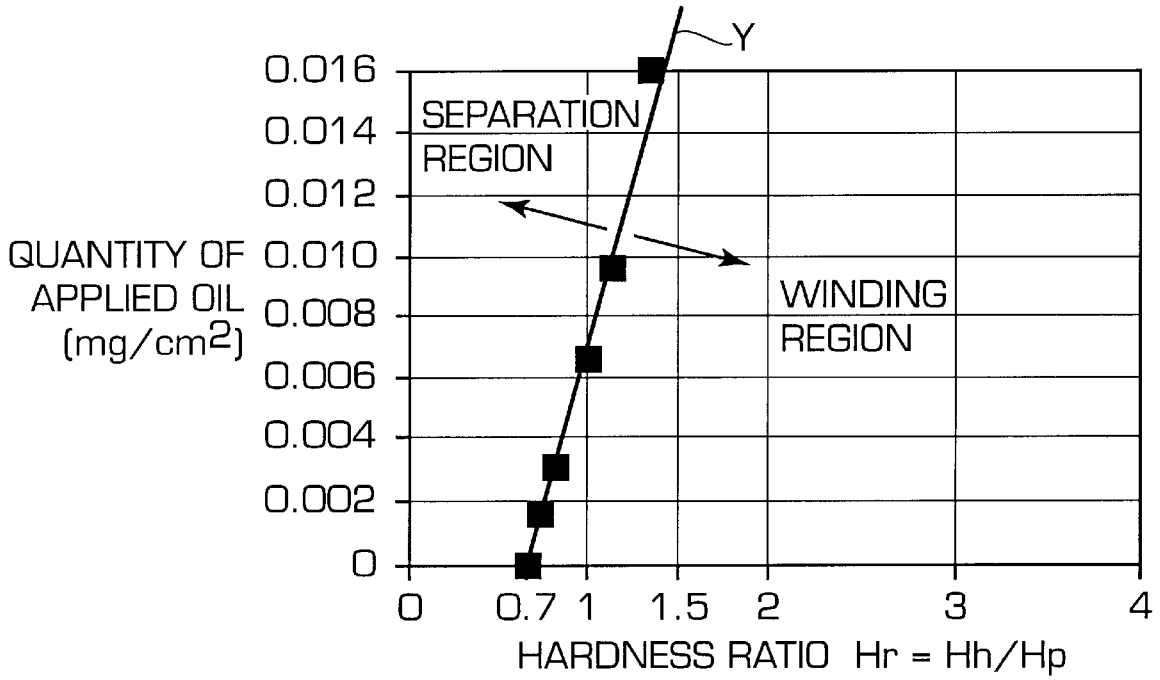
FIG. 7 is a graph showing experimental data.
Figure 8:
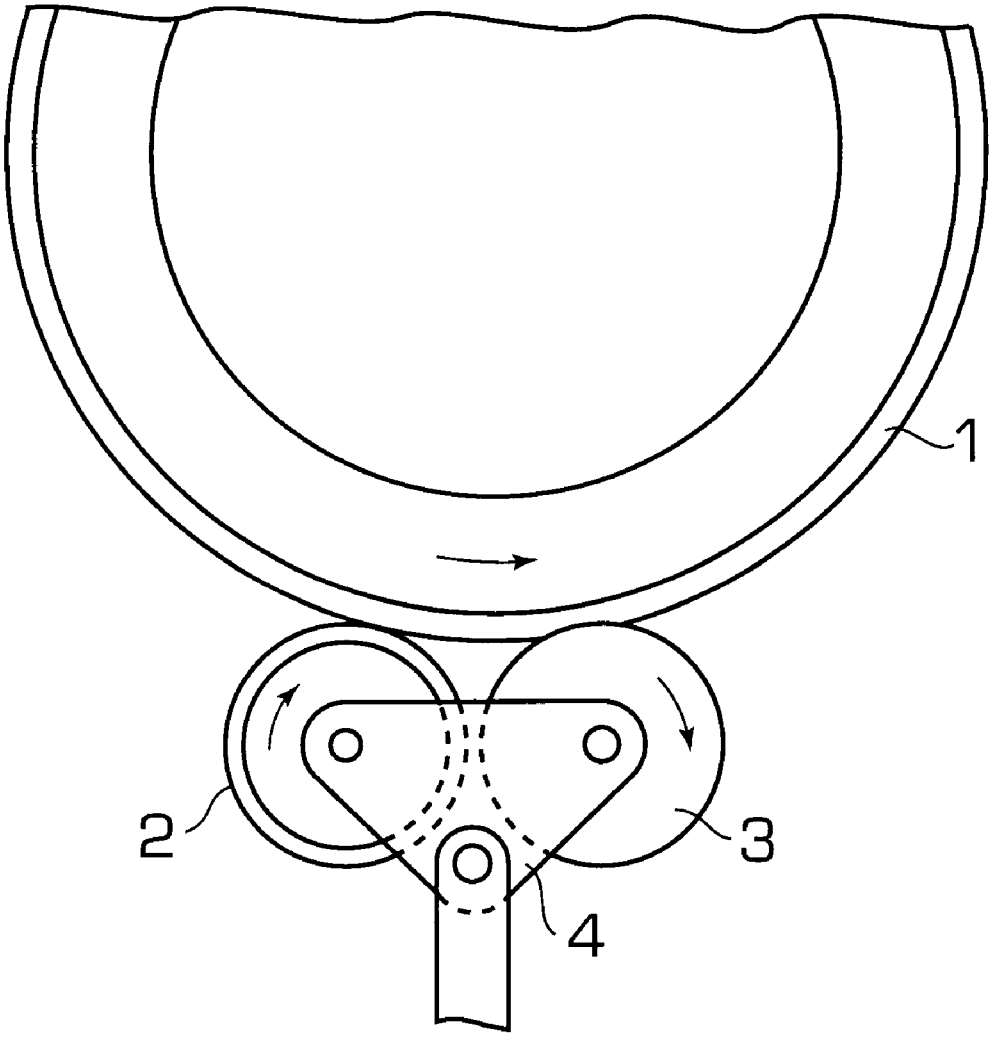
FIG. 8 is a diagram showing a conventional technique.

As can be understood from tables shown in FIGS. 5 and 6 and the graph shown in FIG. 7, a structure in which at least the hardness ratio Hr of the heat roller and the pressing roller is Hr1≧1.5 causes the sheet to be wound even if oil in a relatively large quantity is applied. If the hardness ratio Hr is Hr≦0.7, the sheet is not wound regardless of whether oil is applied to the heat roller.

Note that the largest quantity of applied oil in the foregoing experiments was 0.015873 mg/cm$^2$ (which was 10 mg/a4 in terms of a sheet having the A4-size). If the quantity of oil exceeds the maximum value (10 mg/a4), the sheet absorbs oil in a too large quantity to be used practically.

EXAMPLE

A plurality of heat rollers having different hardness values and a plurality of pressing rollers having different hardness values were combined variously. Then, the pressing roller was brought into contact with the heat roller in such a manner that the quantity of oil applied to the heat roller was changed. Thus, winding of a sheet having a toner image around the heat roller was confirmed. Moreover, the haze (HAZE) which was an indicator of the transparency was measured. Results were shown in FIGS. 5 and 6.

The results were analyzed. As can be understood from A to F shown in table shown in FIG. 5, the haze becomes intensified in proportion to the quantity of applied oil. When attention is focused on G' shown in FIG. 6, D shown in FIG. 5 and F' shown in FIG. 6, which were under the same condition except for the quantity of applied oil, a fact was found that enlargement of applied oil raised the haze. Therefore, the haze was raised in proportion to the quantity of applied oil.

In general, if the haze is not higher than 20, it can be said that the transparency is satisfactory. Therefore, if attention was focused on D in the table, a fact was roughly found that the arrangement in which the quantity of applied oil was 0.00634 mg/cm$^2$ or smaller enabled the value of the haze to be 20 or lower.

As can be understood from F, G and H in the table shown in FIG. 5 and B', A' and C' in the table shown in FIG. 6, the haze is lowered in inverse proportion to the hardness ratio. Another fact was found that the sheet was easily wound around the heat roller as the hardness ratio was raised.

In accordance with results of the experiments, results of A to F in the table shown in FIG. 5 were plotted, and then connected by a straight line. Thus, the relationship between the quantity of applied oil and whether or not sheet was wound was shown in a graph shown in FIG. 7. Note that a portion to the right of line Y was a winding region in which the sheet was wound and a portion to the left was a separation region in which no winding took place. Referring to FIG. 7, straight line A was a line indicating the quantity of oil being 0.006349.

As can be understood from tables shown in FIGS. 5 and 6 and the graph shown in FIG. 7, a structure in which at least the hardness ratio Hr of the heat roller and the pressing roller is Hr>1 and the quantity of applied oil is 0.0063 or smaller causes the sheet to be wound and satisfactory transparency can be realized.

Note that the heat roller had a structure that a silicon rubber layer or a fluorine rubber layer was formed on the surface of an aluminum pipe. The hardness of the heat roller was changed by changing the thickness of the rubber layer.

The pressing roller had a structure that a silicon rubber layer or a fluorine rubber layer was formed on a steel pipe. The hardness of the roller was changed by changing the thickness of the rubber layer. The pressing roller was a roller which may be employed as either of the first pressing roller and the second pressing roller. Therefore, the hardness ratio Hr=Hh/Hp of the heat roller and the pressing roller shown in the table may be used as either of the hardness ratio Hr (=Hh/Hp) of the heat roller and the first pressing roller and the hardness ratio Hr2 (=Hh/Hp2) of the heat roller and the second pressing roller.

Note that the largest quantity of applied oil in the foregoing experiments was 0.015873 mg/cm$^2$ (which was 10 mg/a4 in terms of a sheet having the A4-size). If the quantity of oil exceeds the maximum value (10 mg/a4), the sheet absorbs oil in a too large quantity to be used practically.

EXAMPLE

A plurality of heat rollers having different hardness values and a plurality of pressing rollers having different hardness values were combined variously. Then, the pressing roller was brought into contact with the heat roller in such a manner that the quantity of oil applied to the heat roller was changed. Thus, winding of a sheet having a toner image around the heat roller was confirmed. Moreover, the haze (HAZE) which was an indicator of the transparency was measured. Results were shown in FIGS. 5 and 6.

The results were analyzed. As can be understood from A to F shown in table shown in FIG. 5, the haze becomes intensified in proportion to the quantity of applied oil. When attention is focused on G' shown in FIG. 6, D shown in FIG. 5 and F' shown in FIG. 6, which were under the same condition except for the quantity of applied oil, a fact was found that enlargement of applied oil raised the haze. Therefore, the haze was raised in proportion to the quantity of applied oil.

In general, if the haze is not higher than 20, it can be said that the transparency is satisfactory. Therefore, if attention was focused on D in the table, a fact was roughly found that the arrangement in which the quantity of applied oil was 0.006349 mg/cm$^2$ or smaller enabled the value of the haze to be 20 or lower.

As can be understood from F, G and H in the table shown in FIG. 5 and B', A' and C' in the table shown in FIG. 6, the haze was lowered in inverse proportion to the hardness ratio. Another fact was found that the sheet was easily wound around the heat roller as the hardness ratio is raised.

Figure 11:
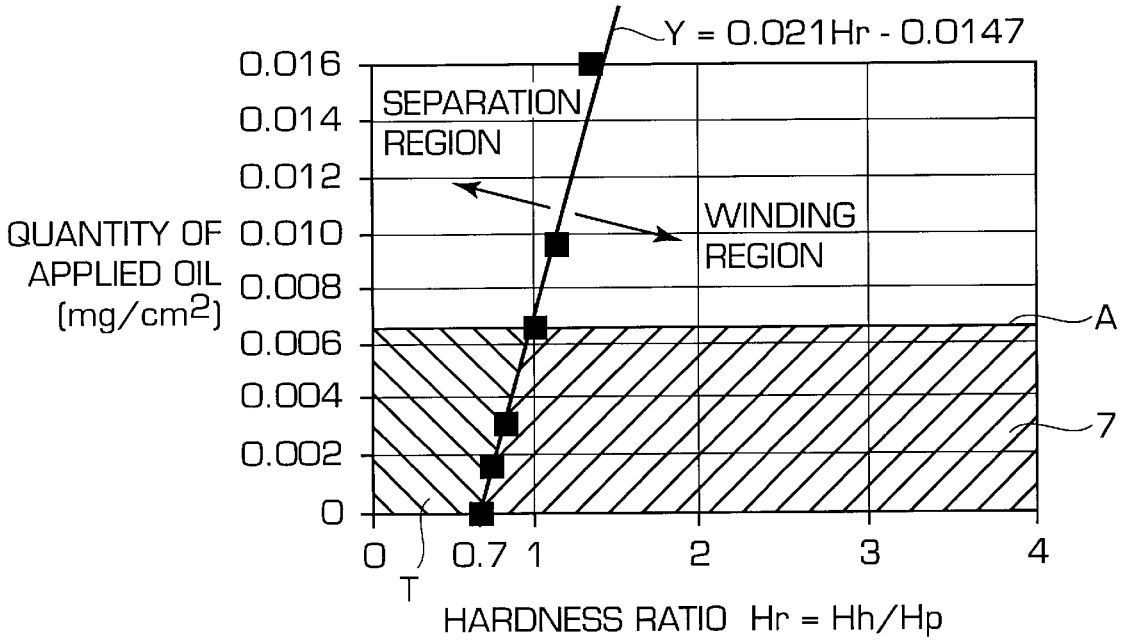
FIG. 11 is a graph showing experimental data.

In accordance with results of the experiments, results of A to F in the table shown in FIG. 5 were plotted, and then connected by a straight line. Thus, the relationship between the quantity of applied oil and whether or not sheet was wound was shown in a graph shown in FIG. 11. In FIG. 11, Y is a straight line showing the foregoing relationship, the straight line Y being a straight line satisfying Y=0.021Hr−0.0147. Note that a portion to the right of line Y was a winding region in which the sheet was wound and a portion to the left was a separation region in which no winding took place. In FIG. 11, straight line A is a line indicating that the quantity of oil=0.006349.

As can be understood from tables shown in FIGS. 5 and 6 and the graph shown in FIG. 11, the relationship between the heat roller 50 and the first pressing roller 60 is required as follows. An assumption is made that the quantity of oil applied to the heat roller 50 is Y mg/cm$^2$, the hardness of the heat roller is Hh, the hardness of the first pressing roller is Hp1 (Hp in the table) and the hardness ratio of the two rollers satisfies Hr1=Hh/Hp1 (Hr in the table). The heat roller 50 and the first pressing roller 60 are structured in such a manner that the quantity of oil is 0.0063 mg/cm$^2$ or smaller and the following relationship is satisfied (a region indicated by a diagonal line a shown in FIG. 11 is satisfied):

$$Y<0.021\times Hr1-0.0147$$

Thus, a fact was found that the sheet allowed to pass through the first nipping portion N1 was wound around the heat roller 50 and transparency not higher than 20 in terms of the haze was realized.

The relationship between the heat roller 50 and the development roller 20 is required as follows. An assumption is made that the quantity of oil applied to the heat roller 50 is Y mg/cm$^2$, the hardness of the heat roller is Hh, the hardness of the second pressing roller is Hp2 (Hp in the table) and the hardness ratio of the two rollers satisfies Hr2=Hh/Hp2 (Hr in the table). The heat roller 50 and the second pressing roller 70 are structured in such a manner that the quantity of oil is 0.0063 mg/cm$^2$ or smaller and the following relationship is satisfied (a region indicated by b diagonal line a shown in FIG. 11 is satisfied):

$$Y\geqq 0.021\times Hr2-0.0147$$

Thus, a fact was found that the sheet allowed to pass through the second nipping portion N2 was not wound around the heat roller 50, the same was separated and transparency not higher than 20 in terms of the haze was realized.

The heat roller used in the experiments had a structure that a silicon rubber layer or a fluorine rubber layer was formed on the surface of an aluminum pipe. The hardness of the heat roller was changed by changing the thickness of the rubber layer. The pressing roller had a structure that a silicon rubber layer or a fluonne rubber layer was formed on a steel pipe. The hardness of the roller was changed by changing the thickness of the rubber layer. The pressing roller was a roller which may be employed as either of the first pressing roller and the second pressing roller. Therefore, the hardness ratio Hr=Hh/Hp of the heat roller and the pressing roller shown in the table may be used as either of the hardness ratio Hr1 (=Hh/Hp1) of the heat roller and the first pressing roller and the hardness ratio Hr2 (=Hh/Hp2) of the heat roller and the second pressing roller.

Note that the largest quantity of applied oil in the foregoing experiments was 0.015873 mg/cm$^2$ (which was 10 mg/a4 in terms of a sheet having the A4-size). If the quantity of oil exceeds the maximum value (10 mg/a4), the sheet absorbs oil in a too large quantity to be used practically.

EMBODIMENTS

Embodiments will now be described.

<Heat roller 50>

The heat roller 50 has a structure that a silicon rubber layer having a thickness of about 2 mm is formed on the surface of an aluminum pipe having an outer diameter of about 31 mm so that the outer diameter is made to be about 35 mm and hardness is made to be about 48 degree. The first pressing roller 60 has a structure that a silicon rubber layer having a thickness of about 2 mm is formed on the surface of a steel pipe having an outer diameter of about 31 mm so that the outer diameter is made to be about 35 mm and the hardness is made to be about 32 degree. Moreover, the ratio of the hardness of the two rollers is made to be about 1.5 (refer to a fixing unit J shown in FIG. 5).

The second pressing roller 70 has a structure that a silicon rubber layer having a thickness of about 2 mm is formed on the surface of the steel pipe having an outer diameter of about 11 mm so that the outer diameter is made to be about 15 mm and the hardness is made to be about 80 degree. Moreover, the ratio of the hardness with respect to the heat roller 50 is made to be about 0.6 (refer to fixing unit J' shown in FIG. 6).

The quantity of oil which is applied to the heat roller 50 is made to be about 0.003175 mg/cm$^2$.

Note that the heat roller 50 has a halogen lamp serving as the heat source 51 in the central portion thereof.

The first pressing roller 60 and the second pressing roller 70 are pressed against the heat roller 50 under pressure in a range from about 30 Kg to about 120 Kg.

<Toner>

Toner having a softening temperature of 130° C. or lower is employed.

Specifically, dense pigment toner having a particle size of 7 $\mu$m is employed. Additives are added to toner in such a manner that the quantity of an additive having a large diameter is 0.5 wt % to 4.0 wt % (more preferably about 0.7 wt %) and the quantity of an additive having a small diameter is 1.5 wt % to 4.0 wt % (more preferably about 2.0 wt %). The additive having the large diameter is required to improve the stable durability. In view of this requirement, it is preferable that a large quantity is added. If the quantity is larger than 4.0 wt %, the fluidity of toner deteriorates. Thus, an adverse influence on preventing image wanting is exerted. The additive having a large diameter is required to improve smoothness in transference to rough quality paper. Therefore, it is preferable that a large quantity is added. If the quantity exceeds 4.0 wt %, airborne silica causes the photosensitive member 10 and the intermediate transfer belt 36 to undesirably encounter filming. The fluidity of toner is made to be about 0.35/cc A.D. and the quantity of electrification is made to be −10 $\mu$C/g or greater.

The quantity of toner before the secondary transfer is performed, that is, the quantity of toner on the intermediate transfer belt 36 is made to be 1.5 mg/cm$^2$ or smaller.

<Guide Member 80>

As shown in FIG. 3, the guide member 80 has a pair of side plates 81 (one of which is illustrated) each of which is formed into a C-like shape, a back plate 82 for establishing the connection between the side plates 81, a guide portion 83 disposed to face the heat roller 50 from the back plate 82 and a guide surface 84 formed as a leading end surface of the guide portion 83.

Since the side plates 81 of the guide member 80 are rotatively supported with respect to the bearings 63 of the first pressing roller 60, the guide member 80 is rotatively supported with respect to the shaft 61 of the first pressing roller 60. A tension spring 85 serving as an urging means is disposed between the guide member 80 and the frame 41. Therefore, the guide member 80 is urged in a direction in which the guide surface 84 approaches the heat roller 50, that is, in a clockwise direction shown in FIG. 3. The rotations of the guide member 80 are restrained because a locating portion (not shown) is brought into contact with the two ends (on the outside the image region) of the heat roller 50. As a result, the guide member 80 is located. In the above-mentioned state, the leading end of the guide surface 84 is disposed adjacent to the outer surface of the first pressing roller 60. Thus, even if the leading end of the sheet allowed to pass through the pressing portion (first nipping portion) N1 between the heat roller 50 and the first pressing roller 60 is not wound around the heat roller 50 for some reason, the sheet can reliably be guided toward the pressing portion (the second nipping portion) N2 between the heat roller 50 and the second pressing roller 70. Moreover, the guide surface 84 is inclined in a direction in which the distance from the heat roller 50 to the outer surface 50 is gradually reduced in a direction in which the sheet is moved.

<Oil-Coating Roller 94>

The oil-coating roller 94 has an oil retention layer made of heat-resistant fiber (for example, felt) or sponge which can be impregnated with oil (silicon oil or the like) having appropriate viscosity. The oil-coating roller 94 has an application-quantity restraining layer made of a porous material, such as tetrafluoroethylene on the surface thereof.

The quantity of oil which must be applied (the quantity of discharge) can be adjusted by adjusting the viscosity of oil, the diameters of pores of the porous film and the density of the porous material.

Specifically, oil is dimethyl silicon oil having viscosity (cst) of about 1000. The quantity (mg/cm$^2$) of oil which is applied to the surface of the heat roller 50 is about 0.005.

The quantity (mg/cm$^2$) of oil which is applied to the surface of the heat roller 50 is about 0.003175 (refer to the fixing unit J shown in FIG. 5 and the fixing unit J' shown in FIG. 6).

Another embodiment of the present invention will now be described.

Each drawing shows a fixing apparatus according to another embodiment of the present invention.

Figure 13:
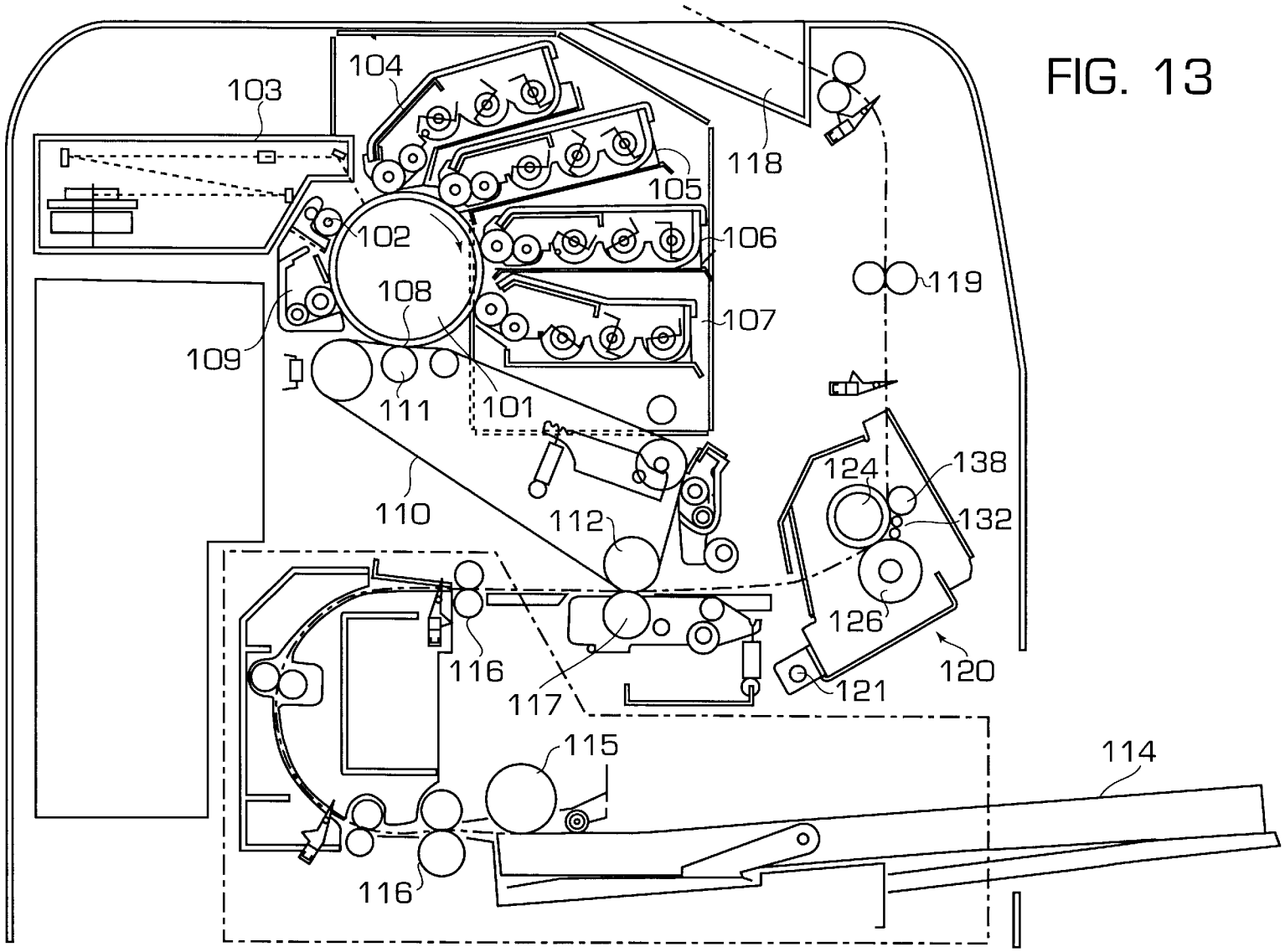
FIG. 13 is a diagram showing the structure of an example of an image forming apparatus having the foregoing apparatus.

Initially, a color image forming apparatus having the fixing apparatus according to the present invention will now be described with reference to FIG. 13.

Referring to the drawing, an electrifying roller 102, a latent-image forming unit 103 of a laser-beam scanning type, yellow, magenta, cyan and black development units 104, 105, 106 and 107 and a cleaning unit 109 are sequentially disposed adjacent to a photosensitive drum given reference numeral 101 when they are viewed from an upstream position in the direction of rotations, the cleaning unit 109 being disposed in such a manner that a transfer portion 108 is interposed. Image forming processes for yellow, magenta, cyan and black are repeated whenever the intermediate transfer belt 110 is rotated so that a toner image corresponding to information which must be recorded is formed.

On the other hand, an endless intermediate transfer belt 110 is arranged to be brought into contact with the photosensitive drum 101 and separated from the same in a transfer portion 108. Thus, a color toner image formed on the surface of the photosensitive drum 101 by the primary transfer roller 111 is secondarily transferred to the surface of a recording medium S by the backup roller 112. The recording mediums S stacked in a paper feeding cassette 114 are allowed to pass through a paper feeding roller 115 and paper moving rollers 116, and then caused to reach a secondary transfer portion 117. In the secondary transfer portion 117, the recording medium S is subjected to a process for transferring a color image using toner. Then, the recording medium S is subjected to a fixing process in a fixing unit 120, and then allowed to pass through a paper-discharge roller pair 119 so as to be discharged to a paper-discharge stacker 118.

Figure 12:
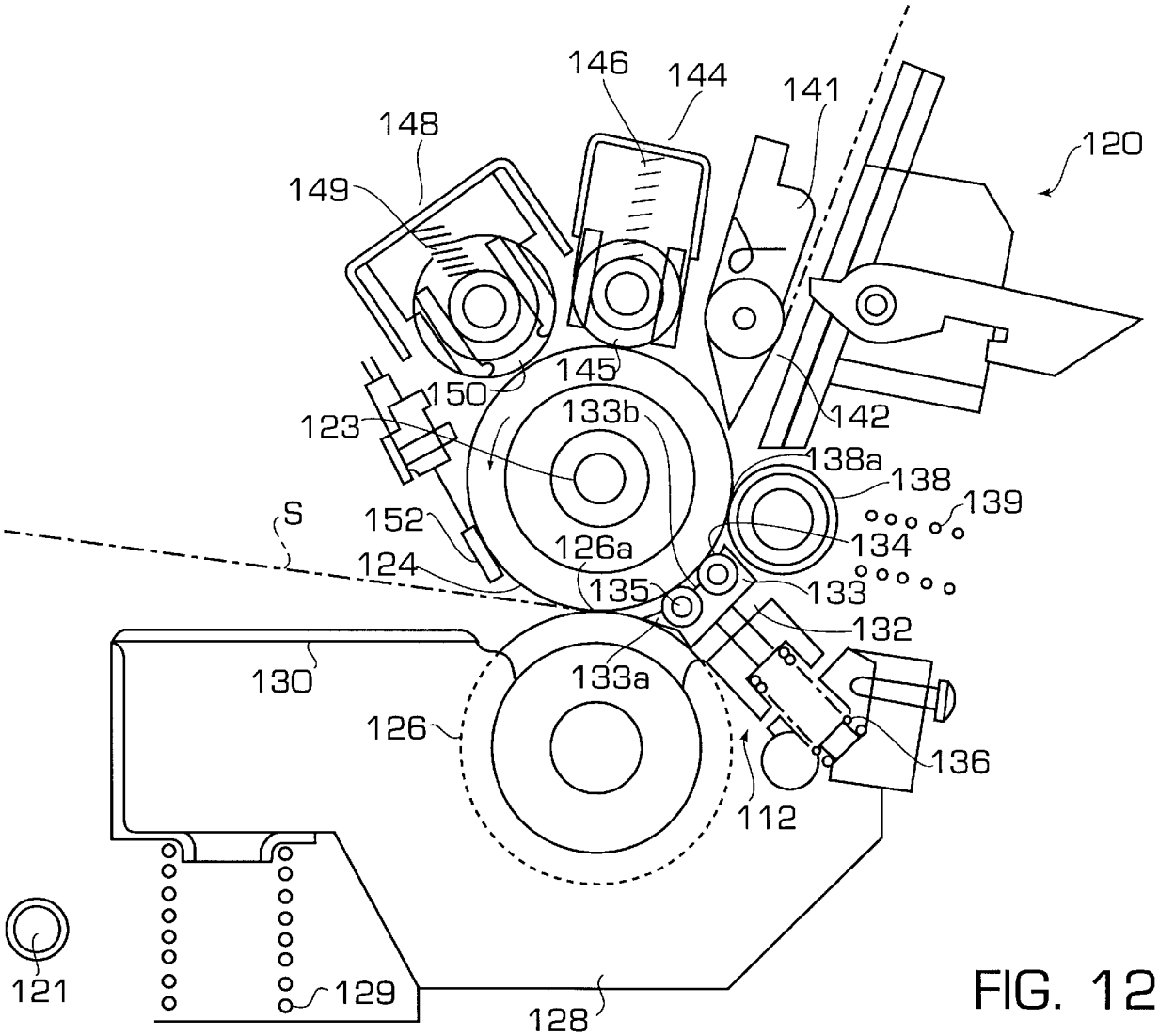
FIG. 12 is a schematic view showing the structure of a fixing apparatus according to an embodiment of the present invention.

FIG. 12 shows the detailed structure of the fixing unit 120. The detailed structure of the fixing unit 120 will now be described. A casing (not shown) for covering the fixing unit 120 is joined to a support-point pin 121 disposed in the lower end of the inside portion of the body of the apparatus so as to permit change after it has been dead. Moreover, when the casing is turned toward a user, change of the development units 104, 105, 106 and 107 is not obstructed.

The fixing unit 120 has a heat roller 124 comprising, in the axial portion thereof, a halogen lamp 123 serving as a heat source, the heat roller 124 being arranged to be rotated by a drive motor (not shown). As shown in FIG. 13, recording medium S moved substantially horizontally from the secondary transfer portion 117 is moved along the surface of the heat roller 124 so that toner is fixed to the surface of the heat roller 124. Then, the recording medium S is allowed to pass through the paper-discharge roller pair 119, and then moved toward the paper-discharge stacker 118 in a substantially upward direction.

The heat roller 124 is made of a material having the hardness of 15 to 90 and a surface roughness of about 0.2 μm. When the determined fixing speed is 100 mm/second to 300 mm/second, the outer diameter of the roller is 20 mm to 80 mm. Moreover, a first pressing roller 126, a guide roller unit 132, a second pressing roller 138, a separating claw 141, a cleaning roller unit 144, an oil-application roller unit 148 and a thermistor 152 are sequentially disposed adjacent to the outer surface of the heat roller 124 from an upstream position in the direction of rotation of the heat roller 124. Moreover, each of the guide roller unit 132, second pressing roller 138, the cleaning roller unit 144 and the 148 is supported by an individual frame so that change of a used part to a new part is permitted.

The first pressing roller 126 is formed into a roller having a large diameter so that the largest possible surface of the first pressing roller 126 is brought into contact with the heat roller 124. Thus, a first pressing roller 126 has a function for pressing the recording medium S against the heat roller 124 so as to heat and soften the toner which adheres to the surface of the recording medium S. Moreover, a pressing force larger than the force which acts on the second pressing roller 138 disposed at the downstream position acts on the first pressing roller 126 by dint of the pressing-roller spring 129 which acts on the frame 128 which supports the pressing-roller spring 129. As a result, a nipping portion 126*a* of the first pressing roller 126 is pressed against the surface of the heat roller 124. Referring to the drawing, reference numeral 130 represents a paper guide disposed on the upper end of the frame 128.

The second pressing roller 138 is disposed downstream of the guide roller unit 132 composed of the heat preservation cover 133 and the guide rollers 134 and 135, the heat preservation cover 133 also serving to preserve the temperatures of the heat roller 124 and the recording medium S. The second pressing roller 138 has a function of pressing the recording medium S against the heat roller 124 to fix toner to the surface of the recording medium S. To realize the foregoing function, the second pressing roller 138 comprises a nipping portion having a curvature larger than that of the first pressing roller 126. That is, the diameter of the second pressing roller 138 is made to be smaller than that of the first pressing roller 126. T-he second pressing roller 138 is pressed against the surface of the heat roller 124 by a pressing-roller spring 139.

The second pressing roller 138 disposed at a downstream position in the direction of rotations has a function of pressing the recording medium S against the heat roller 124 to fix toner to the surface of the recording medium S. The second pressing roller 138 is made of a material having the coefficient of friction which is smaller than that of the first pressing roller 126. Moreover, the second pressing roller 138 has the curvature larger than that of the first pressing roller 126. That is, the outer diameter of the second pressing roller 138 is smaller than that of the first pressing roller 126. The second pressing roller 138 receives relatively small pressing force from the pressing-roller spring 139 so that the second pressing roller 138 is pressed against the surface of the heat roller 124.

On the other hand, the foregoing guide roller unit 132 has a function of introducing the recording medium S from the first pressing roller 126 to the following second pressing roller 138 and a function of preventing radiation of heat from the surface of the heat roller 124 during the introduction of the recording medium S. The guide roller unit 132 comprises a heat preservation cover 133 made of heat-resistant plastic and the front and rear guide rollers 134 and 135, each of which is made of a heat insulating material and arranged to support the heat preservation cover 133 at a position adjacent to the surface of the heat roller 124.

The heat preservation cover 133 is disposed adjacent to the nipping portion 126*a* of the first pressing roller 126 in such a manner that the leading end 133*a* of the heat preservation cover 133 is positioned closer to the nipping portion 126*a* than the width of the non-printing region of the recording medium S. Moreover, rib-shape bottom ends 133*b* are disposed at intervals of 3 mm or smaller, preferably 1 mm or smaller to face the heat roller 124 in such a manner that a circular-arc guide surface is formed along the surface of the heat roller 124. The front and rear guide rollers 134 and 135 are pressed against the surface of the heat roller 124 so as to be rotated by a relatively-weak pressing spring 136 which acts on the heat preservation cover 133 in order to prevent radiation of heat by dint of the nipping portion of the guide rollers 134 and 135 and the heat preservation cover 133.

Since the heat preservation cover 133 is formed into the rib shape, the heat preservation cover 133 may be made of a metal material because the heat insulating characteristic of air acts on the heat preservation characteristic.

The upstream guide roller 135 of the two guide rollers 134 and 135 is disposed adjacent to the nipping portion 126*a* of the first pressing roller 126 in such a manner that the distance from the nipping portion 126*a* to the upstream guide roller 135 is shorter than the width of the non-printing region of the recording medium S. Thus, the leading end of the recording medium S is allowed to pass through the nipping portion 126*a* of the first pressing roller 126 without being separated from the surface of the heat roller 124.

The guide rollers 134 and 135 are made of a hard material, such as aluminum or heat-resistant plastic or a material incorporating an elastic layer on the hard material and having hardness of 15 to 90 degree and surface roughness of 0.2 μm to 10 μm. When the fixing speed is made to be 100 mm/second to 300 mm/second, the outer diameter is made to be 2 mm to 10 mm, preferably 6 mm. Moreover, the nipping width is made to be 0.2 mm to 10 mm and the contact pressure is made to be 0.005 $Kgf/cm^2$ to 33 $Kgf/cm^2$ because the guide rollers 134 and 135 are pressed against the surface of the heat roller 124 by the spring 136 with the pressing force of 0.1 Kgf to 35 Kgf.

The separating claw 141 disposed downstream of the fixing unit 120 separates the recording medium S allowed to pass through the second pressing roller 138 from the surface of the heat roller 124. The separating claw 141 is made of heat-resistant plastic is coated with PFA. Moreover, a decal roller 142 made of heat-resistant plastic for giving a curvature inverse to that of a curl formed by the pressing rollers 126 and 138 and the guide roller 134 is rotatively joined to the downstream position.

The cleaning roller unit 144 for removing offset toner allowed to adhere to the heat roller 124 has a structure that a roller 145 in the form of an aluminum hollow pipe is pressed against the surface of the heat roller 124 by the urging force of a spring 146. A oil-application roller unit 148 disposed downstream of the cleaning roller unit 144 has a roller formed by coating a steel core with sponge rubber to serve as an oil retention layer. The roller is pressed against the surface of the heat roller 124 by a spring 149 so that dimethyl silicon oil having viscosity of 100 to 100000 is applied to the heat roller 124.

In the drawing, reference numeral 152 represents a thermistor disposed downstream of the oil-application roller unit 148 and arranged to detect the temperature of the surface of the heat roller 124 to control the quantity of electric power to the halogen lamp 123.

The operation of the apparatus having the above-mentioned structure for fixing a color toner image to the surface of a recording paper S will now be described.

Solid color-images formed by yellow, cyan, magenta and black toner as a result of the image forming process performed whenever the photosensitive drum 101 is rotated are, in the transfer portion 108, sequentially transferred to the surface of the intermediate transfer belt 110. Then, the solid color-images are transferred to the surface of the recording paper S in the secondary transfer portion 117.

The recording paper S to which the solid color images have been transferred is introduced into the fixing unit 120, and then guided by the paper guide 130 so as to be moved to the heat roller 124. Thus, the recording paper S is heated while it is strongly pressed to the surface of the heat roller 124 by the nipping portion 126*a* of the first pressing roller 126.

Therefore, toner on the recording paper S is softened by the heat of the heat roller 124, and then the recording paper S is guided by the guide rollers 134 and 135 of the following guide roller unit 132 and by the bottom end 133*b* of the heat preservation cover 133 so as to be moved to the second pressing roller 138. Then, toner stacked into a multilayered structure is again heated by the heat roller 124 so as to be kneaded in the recording paper while it is mixed into a film form so that toner is fixed.

As described above, each of the first pressing roller 126 having the main function of melting toner and the second pressing roller 138 having the main function of the fixing operation is made of the material having the hardness of 15 to 90 and the surface roughness of 0.2 $\mu$m to 10 $\mu$m. Moreover, the pressing rollers 126 and 138 are rotated by the drive motor. To have the corresponding functions, the pressing rollers 126 and 138 are formed and disposed under the following condition.

That is, pressing load F1 which acts on the first pressing roller 126 is made to be 0.4 Kgf to 100 Kgf, preferably 12 Kgf so as to be larger than pressing load F2 of the second pressing roller 138 which is 0.3 Kgf to 70 Kgf, preferably 6 Kgf or larger. Thus, the nipping width realized by the first pressing roller 126 is enlarged to cause toner on the recording medium S to be brought into contact with the heat roller 124 with a large surface. As a result, heating and melting toner can effectively be performed. Contact pressure P2 of the nipping portion 138*a* of the second pressing roller 138 is made to be 0.006 Kgcm$^2$ to 40 Kgcm$^2$ which is larger than 0.004 Kgf/cm$^2$ to 28 Kgf/cm$^2$ of the first pressing roller 126. As a result, the recording medium is strongly pressed against the surface of the heat roller 124 by the second pressing roller 138. Thus, toner allowed to adhere to the surface of the heat roller 124 and thus softened is embedded among fibers of the recording medium S attributable to large pressing force so as to be anchored. As a result of the anchoring effect, great fixing strength is realized. Moreover, toner stacked into a multilayered form is compressed and deformed so that toner is mixed into a film form. Thus, satisfactory color development characteristic can be obtained.

The width N1 of the nipping portion 126*a* of the first pressing roller 126 is made to be 1 mm to 25 mm, preferably 8 mm. Moreover, the width N2 of the nipping portion 138*a* of the second pressing roller 138 is made to be 0.5 mm to 15 mm, preferably larger than 2.5 mm. That is, the outer diameter of the first pressing roller 126 is made to be larger than the outer diameter of the second pressing roller 138. As an alternative to this, the first pressing roller 126 is made of a material which is softer than that of the second pressing roller 138. Thus, the recording medium S is brought into contact with the heat roller 124 with a largest possible surface so as to effectively heat and melt toner.

The pressing load of the first pressing roller 126 is made to be larger than that of the second pressing roller 138. Moreover, the coefficient of friction of the surface of the first pressing roller 126 is made to be larger than that of the second pressing roller 138. Thus, the frictional force of the nipping portion of the first pressing roller 126 is made to be larger than that of the second pressing roller 138. As a result, the recording medium is strongly held by the nipping portion of the first pressing roller 126 so that the second pressing roller 138 is slipped on the surface of the recording medium. Therefore, toner can be melted without disorder to the toner image. Moreover, even if the recording medium has a double-sheet structure like an envelope, the fixing process can be performed without generation of a crease or a curl.

In addition to the above-mentioned condition, the paper moving speed realized by the first pressing roller 126 is reduced as compared with the paper moving speed realized by the second pressing roller 138 or the paper-discharge roller pair 119. Thus, the processes for melting and fixing toner can be performed in a state where the recording medium is always in contact with the surface of the heat roller 124 while disorder of the toner image is prevented.

On the other hand, the temperature of the surface of the heat roller 124 is partially lowered during the process for softening toner allowed to adhere to the recording medium S in cooperation with the first pressing roller 126. Then, the portion having the lowered temperature is covered with the heat preservation cover 133 of the guide roller unit 132 and the front and rear guide rollers 134 and 135 so that heat radiation from the portion is prevented. As a result, the temperature is restored in a short time. Since toner is furthermore heated and pressed at the nipping portions of the guide rollers 134 and 135, toner is furthermore softened between the first pressing roller 126 and the second pressing roller 138. Then, toner is again pressed and heated in the nipping portion of the second pressing roller 138 so that toner is introduced into the recording paper and deformed into a film shape. Thus, toner is fixed to the recording paper.

The heat preservation cover 133 of the guide roller unit 132 has another function of moving the recording medium allowed to pass through the first pressing roller 126 along the heat roller 124 so as to reliably guide the recording medium to the position of the second pressing roller 138. Therefore, the heat preservation cover 133 of the guide roller unit 132 is provided with a third guide roller which is brought into contact with the first pressing roller 126 so as to be rotated, the third guide roller being disposed on the surface of the heat preservation cover 133 opposite to the first pressing roller 126. Thus, a space which is smaller than the width of the non-printing region of the recording medium may be formed between the heat preservation cover 133 and the first pressing roller 126. In this case, separation of the leading end of the recording medium from the heat roller 124 can satisfactorily be prevented. Moreover, the region of the separation can be made to be outside of the printing region.

The guide rollers 134 and 135 must be brought into contact with the surface of the heat roller 124 so as to be rotated without deflection in order to prevent heat radiation. Therefore, the guide rollers 134 and 135 may be sectioned into a plurality of rollers so as to be brought into contact with the surface of the heat roller 124. Thus, the plural rollers are rotated.

Figure 14:
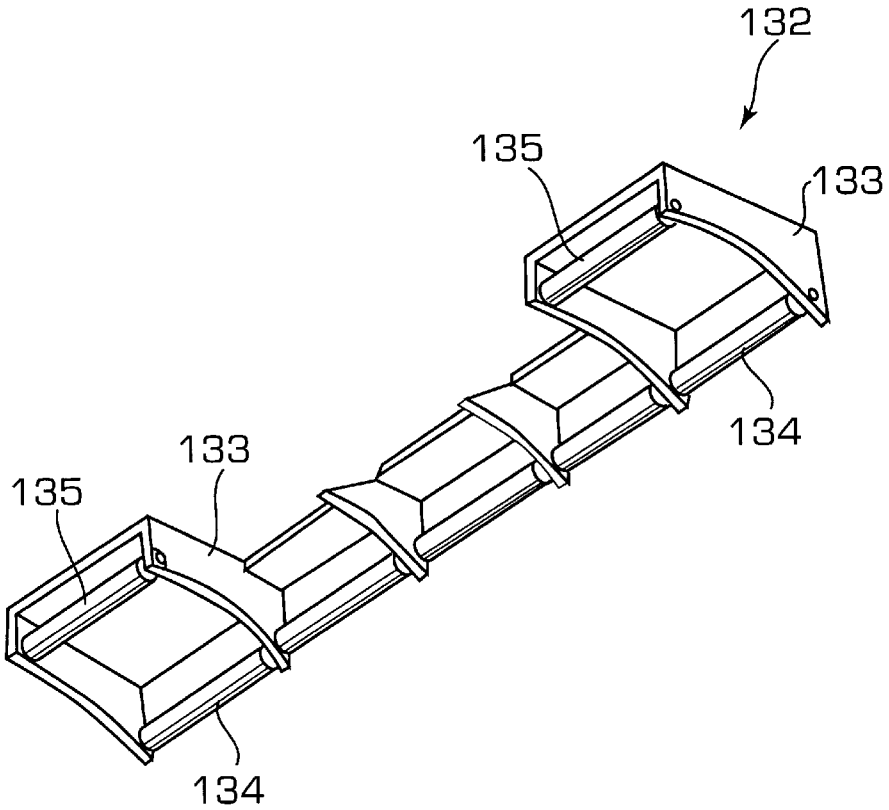
FIG. 14 is a perspective view showing a portion of a guide roller unit according to another embodiment of the present invention when it is viewed from a lower position.
Figure 15:
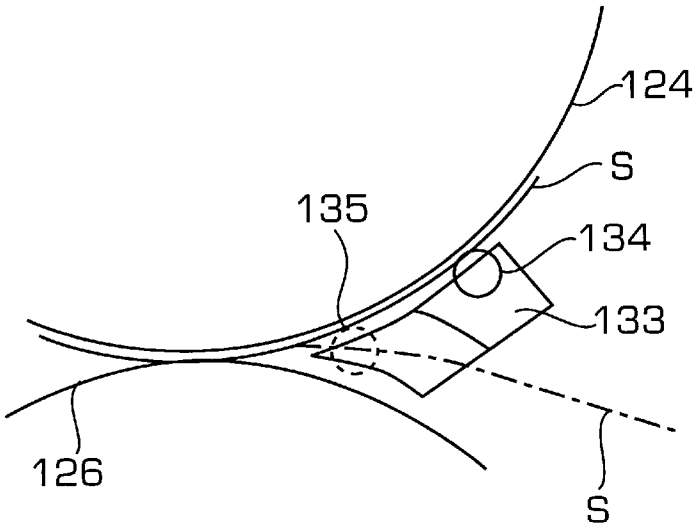
FIG. 15 is a diagram showing a passage through which plain paper and recording paper having a small width are moved by the guide roller unit.

The embodiment shown in FIGS. 14 and 15 is structured to satisfactorily perform the fixing process by using a recording medium, such as a postcard or an envelope, having a small width and a large thickness. The guide roller unit 132 has a structure that the roller 135 of the rollers 135 disposed in the upstream position in the direction in which the paper is moved which is disposed in a portion through which the postcard and the envelope is allowed to pass is removed together with a portion of the heat preservation cover 133. When the foregoing recording medium is introduced to the guide roller unit 132, the recording medium is directly discharged from the first pressing roller 126 as indicated by an alternate long and two short dashes line shown in FIG. 15. As a result, strong bending force does not act on the recording medium S, such as the thick recording medium or a medium having a double-sheet structure. Thus, generation of a crease and the like can be prevented.

The heat preservation cover 133 of the guide roller unit 132 has another function which is capable of reliably guiding the recording medium, which has been allowed to pass through the first pressing roller 126, along the heat roller 124 to the second pressing roller 138. Therefore, the heat preservation cover 133 of the guide roller unit 132 is provided with a third guide roller which is brought into contact with the first pressing roller 126 so as to be rotated, the third guide roller being disposed on the surface of the heat preservation cover 133 opposite to the first pressing roller 126. Thus, a space which is smaller than the width of the non-printing region of the recording medium may be formed between the heat preservation cover 133 and the first pressing roller 126. In this case, a structure can be formed in such a manner that a curl of the heated recording medium can be prevented and thus discharge of the recording medium to the outside along the first pressing roller 126 to the outside can be prevented.

Figure 16:
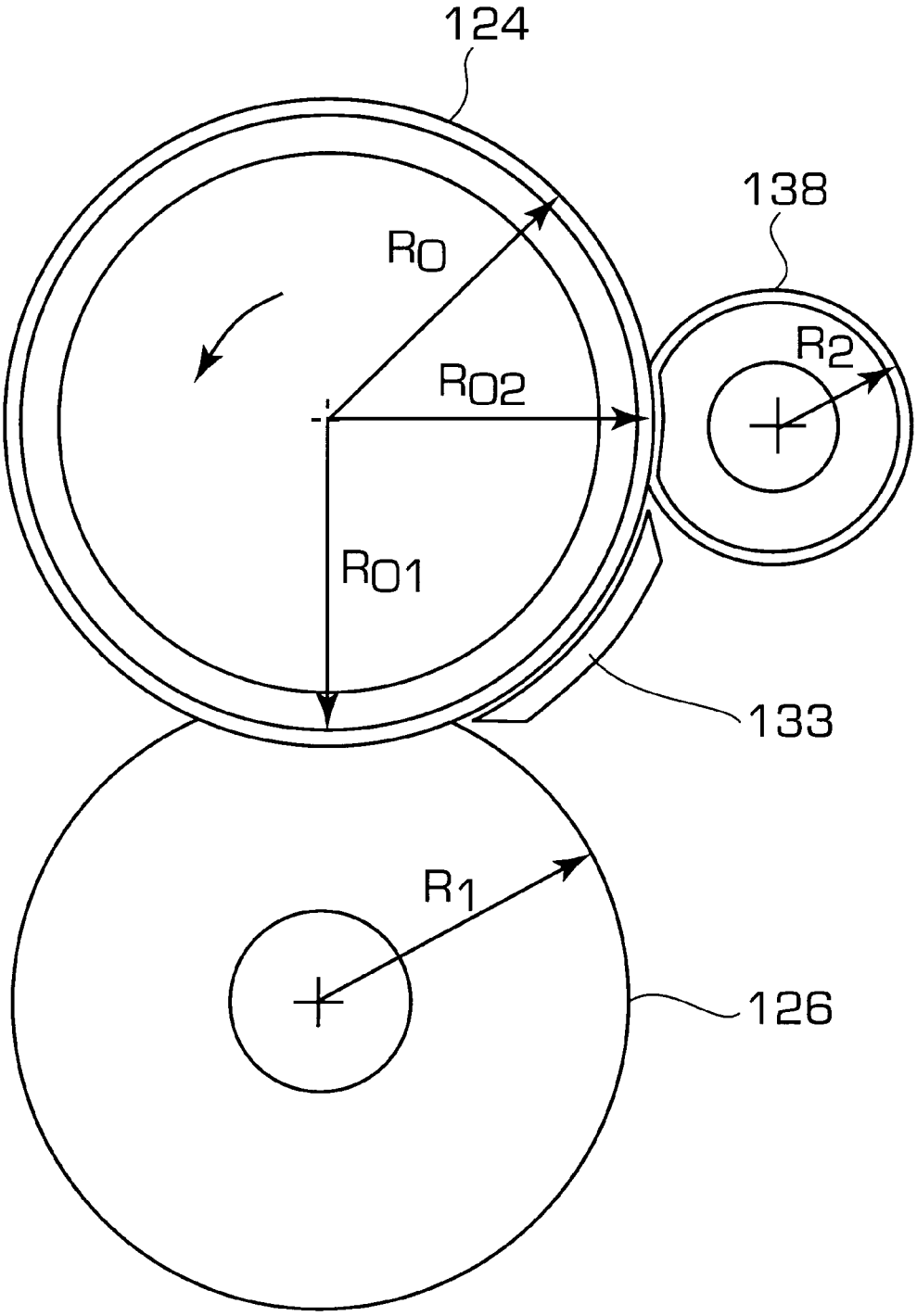
FIG. 16 is a diagram showing the structure of an example of a nipping portion of the above-mentioned apparatus.

Since the shape of the nip is a very important fact to prevent generation of a crease of an envelope and a curl of paper, the shape will now be described with reference to FIG. 16.

The heat roller 124, the first pressing roller 126 and the second pressing roller 138 have curvature radii R0, R1 and R2, respectively in the compressed portions. The curvature radius of the heat roller 124 is R01 in the nipping portion realized together with the first pressing roller 126 and R02 in the nipping portion realized together with the second pressing roller 138. The curvature radii are made to satisfy R01>R0 and R01>R1 so that the recording medium is placed along the heat roller 124 to reliably transmit heat to the recording medium. Thus, toner can easily be melted. Moreover, the difference between the speed of the right side of the recording medium and that of the reverse side of the same can be reduced. As a result, a crease of an envelope and a curl of paper can be prevented. When the relationship is made to satisfy R02>R0 and R02 >R2, heat transmission can reliably be performed to enhance fixation of toner. In addition, generation of a crease of an envelope and a curl of paper can be prevented. Moreover, the recording medium can easily be separated. Since the gap from the heat roller 124 to the heat preservation cover 133 is made to be small (1 mm or smaller), the heat preservation characteristic can be improved to raise the fixation ratio. In addition, the difference between the speed of the first pressing roller and that of the second pressing roller can be absorbed so that nonuniformity in fixation (nonuniformity in glossiness) is prevented. If the above-mentioned guide roller which is brought into contact with the heat roller 124 is provided for a portion of the heat preservation cover 133, it is preferable that the guide roller is not divided in the axial direction and the same is provided over the image region to prevent damage at the end of the shaft.

When molten toner is caused to reliably penetrate a recording medium so as to be fixed to the same, the second pressing roller 138 plays an important role. The second pressing roller 138 will now be described.

The temperature of the surface of the nipping portion 138*a* of the second pressing roller 138 is made to be higher than the temperature of the surface of the nipping portion 126*a* of the first pressing roller 126. Thus, the surface of the recording medium to which toner has been allowed to adhere can be heated from the rear side so that toner is caused to penetrate the recording medium under the pressure of the nipping portion. It leads to a fact that toner can sufficiently be allowed to penetrate the recording medium to correspond to the pressure of the second pressing roller 138 without cooling and solidifying molten toner which is being allowed to penetrate the recording medium. Thus, a satisfactorily large anchoring effect can be obtained. Therefore, even if a color image is fixed at high speed, an image exhibiting a high fixation ratio can be formed. If toner having an unsatisfactory thermal fusion characteristic is used to form a mat color image having poor surface glossy, higher fixing temperatures are required. Therefore, a fixing apparatus for forming a mat image is enabled to quickly and reliably fix toner.

The thermal capacity of the second pressing roller 138 is made to be smaller than that of the first pressing roller 126 so that heat is received from the heat roller 124 in a region, for example, a space between paper sheets, in which no recording medium exists. As a result, an image exhibiting a high fixation ratio can be formed as described above.

The heat conductivity of the second pressing roller 138 is made to be lower than that of the first pressing roller 126 so that the saturation temperature after the temperature has been raised because of receive of heat from the heat roller 124 is raised. Thus, an image exhibiting a high fixation ratio can be formed as described above.

The outer diameter of the second pressing roller 138 is made to be smaller than that of the first pressing roller 126 so that the diameter of the second pressing roller is reduced and thus a small-size roller is realized. Moreover, the temperature can quickly be raised even in a short region between paper sheets. As a result, the operation speed of the image forming apparatus can be realized. Moreover, an advantage can be realized when a recording medium is curvature-separated.

In addition to the above-mentioned conditions; the paper feeding speed of the first pressing roller 126 is made to be lower than the paper feeding speed of the second pressing roller 138 or the paper-discharge roller pair 119. Thus, toner can be melted and fixed without disorder of the toner image in a state in which the recording medium is always in contact with the surface of the heat roller 124. In the passage for a recording medium formed from the secondary transfer portion to the paper-discharge roller, the speed is raised in the downstream direction. Thus, generation of a crease can be prevented and disorder of an image occurring attributable to slippage can be prevented. It is preferable that the passage is arranged in such a manner that the force for gripping a recording medium is reduced in the downstream direction from the fixing portion to prevent slippage in the fixing portion and disorder of the image.

The fixing apparatus of the invention is able to realize a state of fixation free from nonuniformity over a sheet. The sheet can smoothly be separated from the heat roller. An image exhibiting excellent transparency can be obtained.

Furthermore, the fixing apparatus of the invention enables an image to be obtained which is in a fixation state free from nonuniformity over a sheet and which exhibits excellent transparency. Moreover, the sheet can smoothly be separated from the heat roller.

The present invention is arranged in such a manner that the two pressing rollers are disposed on the surface of the heat roller in a region in which the contact with a recording medium is made. Moreover, the pressing roller disposed in the upstream position is arranged to have a large outer diameter, width of the nipping portion or pressing load-to have the function of melting toner. On the other hand, the pressing roller positioned in the downstream position has a large curvature or contact pressure to have the function of fixing toner. Thus, the pressing rollers disposed in the upstream position and the downstream position have the corresponding function of heating toner and the function of fixing toner to a recording medium. Thus, a high-duty fixing operation to form a solid image by using toner in a multiplicity of colors can quickly and efficiently be performed.

Since temporary fall in the temperature occurring due to the process for melting toner can be restored between the pressing rollers, the following process for fixing toner can efficiently be performed.

Moreover, the present invention is structured in such a manner that a recording-medium guide means having a function of preventing radiation of heat from the heat roller and a function of guiding the recording medium is disposed between the two pressing rollers disposed on the heat roller. Therefore, temporary fall in the temperature occurring due to the process for melting toner in cooperation with the upstream pressing roller can quickly be restored by the guide means. Thus, the process for fixing toner can furthermore efficiently be performed in cooperation with the downstream pressing roller. Thus, a high-duty fixing process for fixing a solid color image can quickly be performed. Moreover, the foregoing member enables the recording medium to reliably be introduced into the downstream pressing roller.

If the portion of the recording-medium guide means through which a small-width recording medium is allowed to pass is removed, the small-width and thick recording medium is directly discharged to the outside of the apparatus from the upstream pressing roller. Thus, generation of a crease or the like which takes place during the fixing process can be prevented.

As described above, the present invention has the structure that the two pressing rollers are disposed on the surface of the heat roller in a region in which the contact with a recording medium is made. Moreover, the curvature radius of the upstream pressing roller is made to be larger than that of the heat roller and the upstream pressing roller. Therefore, the function of heating toner and the function of fixing toner to a recording medium are performed by the corresponding pressing rollers disposed at the upstream position and the downstream position, respectively. Therefore, a high-duty fixing operation to form a solid image by using toner in a multiplicity of colors can quickly and efficiently be performed. Since transmission of heat can reliably be performed, toner can easily be melted. In addition, the difference between the speed of the right side of a recording medium and that of the reverse side of the same can be reduced so that generation of a crease of an envelope and a curl of paper are prevented.

The curvature radius of the nipping portion of the downstream pressing roller is made to be larger than the curvature radius of the heat roller and that of the downstream pressing roller. Therefore, transmission of heat can reliably be performed so that fixation of toner is easily be performed. In addition, generation of a crease of an envelope and a curl of paper can be prevented and separation of the recording medium can easily be performed.

Since the recording-medium guide means for covering the outer surface of the heat roller and guiding a recording medium is disposed between the two pressing rollers, the heat preservation characteristic can be improved and thus the fixation ratio can be raised. In addition, the difference between the speed of the first pressing roller and that of the second pressing roller can be absorbed to prevent nonuniformity in fixation (nonuniformity in the glossiness).

The present invention has the structure that the two pressing rollers are disposed on the surface of the heat roller in a region in which the contact with a recording medium is made. Moreover, the temperature of the surface of the nipping portion of the upstream pressing roller is made to be lower than that of the surface of the nipping portion of the downstream pressing roller. Therefore, a high-duty fixing operation to form a solid image by using toner in a multiplicity of colors can quickly and efficiently be performed. Since penetration of toner into the recording medium can reliably be performed, fixation of toner can reliably be performed.

Since the thermal capacity of the downstream pressing roller is made to be smaller than that of the upstream pressing roller, the temperature can quickly be raised by receiving heat from the heat roller. Thus, an image exhibiting a high fixation ratio can be formed.

Since the heat conductivity of the downstream pressing roller is made to be smaller than that of the upstream pressing roller, the saturation temperature after the temperature has been raised can be raised. As a result, an image exhibiting a high fixation ratio can be formed as described above.

Since the outer diameter of the downstream pressing roller is made to be smaller than that of the upstream pressing roller, the size reduction and high speed operation can simultaneously be realized.

What is claimed is:

1. A fixing apparatus comprising:

a heat roller having a heat source therein; and first and second pressing rollers arranged to be pressed sequentially against said heat roller beginning with a more upstream pressing roller in a direction of rotation of said heat roller, wherein when the hardness of said heat roller is Hh, the hardness of said first pressing roller is Hp1, the hardness of said second pressing roller is Hp2, said heat roller and said first and second pressing rollers are structured in such a manner that the following condition is satisfied:

$Hh/Hp \geqq 1.5$ and $Hh/Hp2 \leqq 0.7$.

2. A fixing apparatus comprising:

a heat roller having a heat source therein; and first and second pressing rollers arranged to be pressed sequentially against said heat roller beginning with a more upstream pressing roller in a direction of rotations of said heat roller; and a quantity of oil applied to an outer surface of said heat roller, wherein the hardness of said first pressing roller is made to be lower than the hardness of said heat roller, the quantity of oil is 0.0063 mg/cm$^2$ or smaller, and when the hardness of said heat roller is Hh, the hardness of said second pressing roller is Hp2, the following condition is satisfied $Hh/Hp2 \leqq 0.7$.

3. A fixing apparatus comprising:

a heat roller having a heat source therein; and first and second pressing rollers arranged to be pressed sequentially against said heat roller beginning with a more upstream pressing roller in a direction of rotation of said heat roller, a quantity of oil applied to an outer surface of said heat roller, wherein when the quantity of oil which is applied to said heat roller is Y mg/cm$^2$, the hardness of said heat roller is Hh, and the hardness of said first pressing roller is Hp1, the quantity Y of oil is 0.0063 mg/cm$^2$ or smaller, and said heat roller and said first pressing roller are structured in such a manner that the following condition is satisfied:

$Y<0.021\times Hh/Hp1-0.0147$.

4. The fixing apparatus according to claim 3, wherein when the hardness of said second pressing roller is Hp2, said heat roller and said second pressing roller are structured in such a manner that the following condition is satisfied:

$Y \geqq 0.021\times Hh/Hp2-0.0147$.

5. A toner fixing apparatus comprising:

a heat roller; and first and second pressing rollers disposed in contact with said heat roller at upstream and downstream positions, respectively, in a direction of rotation of said heat roller, said first pressing roller disposed in the upstream position presses a recording medium against the heat roller with a first pressure so as to heat and soften a toner adhered to the recording medium, said second pressing roller presses the recording medium against the heat roller with a second pressure, wherein said first pressure is larger than said second pressure, and the radius of curvature of said second pressing roller is larger than the radius of curvature of said first pressing roller.

6. A toner fixing apparatus according to claim 5, wherein said first pressing roller, has a smaller curvature than a curvature of said second pressing roller, thereby forming a nipping portion of the first pressure roller which is larger than a nipping portion of the second pressure roller, thereby causing said first pressing roller to melt toner.

7. The toner fixing apparatus according to claim 5, wherein said first pressing roller disposed in the upstream position is caused to have a main function of melting toner by making the outer diameter of a nipping portion of said first pressing roller to be larger than that of said second pressing roller disposed at the downstream position.

8. The toner fixing apparatus according to claim 7, wherein said second pressing roller disposed at the downstream position fixes the toner on a printing sheet.

9. The toner fixing apparatus according to claim 5, wherein said pressing roller disposed in the upstream position is caused to have a main function of melting toner by making the frictional force of a nipping portion of said upstream pressing roller which acts on a recording medium, and said heat roller is made to be larger than that of said pressing roller disposed at the downstream position.

10. A toner fixing apparatus comprising:

a heat roller; and two pressing rollers disposed in contact with said heat roller at upstream and downstream positions respectively in a direction of rotations of said heat roller in a region in which the contact with a recording medium is made, wherein said pressing roller disposed in the upstream position is caused to have a main function of melting toner by making the friction coeffcient of a nipping portion of said upstream pressing roller to be larger than that of said pressing roller disposed at the downstream position.

11. A toner fixing apparatus comprising:

a heat roller; and two pressing rollers disposed in contact with said heat roller at upstream and downstream positions respectively in a direction of rotation of said heat roller in a region, wherein said pressing roller disposed in the upstream position is caused to have a main function of melting toner by making the pressing load of said upstream roller larger than that of said pressing roller disposed in the downstream position, and wherein when the hardness of said heat roller is Hh, the hardness of said second pressing roller is Hp2, the following condition is satisfied: $Hh/Hp2 \leqq 0.7$.

12. A toner fixing apparatus comprising:

a heat roller having an outer surface;

two pressing rollers disposed to be in contact with said heat roller at upstream and downstream positions respectively in a direction of rotation of said heat roller; recording-medium guide means disposed between said two pressing rollers and structured to cover the surface of said heat roller so as to block heat radiation from said heat roller;

a heat preservation cover for covering said heat roller and serving as a guide for the recording medium; and a roller member further acting to support said heat preservation cover and guide the recording medium.

13. The toner fixing apparatus according to claim 12, wherein said heat preservation cover is formed into a rib shape made of a heat-resistant material.

14. The toner fixing apparatus according to claim 12, wherein the distance from an end of said heat preservation cover in an upstream direction of rotation of said heat roller to a nipping portion of said upstream pressing roller is shorter than the width of a non-printing region of the recording medium.

15. The toner fixing apparatus according to claim 12, wherein said heat preservation cover has an interval-restraining roller arranged to be brought into contact with said upstream pressing roller so as to be rotated.

16. The toner fixing apparatus according to claim 12, wherein said roller member is made of a heat-resistant material.

17. The toner fixing apparatus according to claim 12, said roller member comprises at least two roller members disposed at an upstream position and a downstream position in a direction of rotation of heat roller, respectively.

18. The toner fixing apparatus according to claim 12, wherein said rolling member is sectioned into a plurality of members in the axial direction so as to be independently rotated.

19. The toner fixing apparatus according to claim 12, wherein a distance from said roller member disposed in an upstream position to a nipping portion of said upstream pressing roller is shorter than the width of a non-printing region of the recording medium.

20. The toner fixing apparatus according to claim 12, wherein a portion of said heat preservation cover and a portion of said roller member are removed in a region through which a recording medium having a small width is allowed to pass.

21. A toner fixing apparatus comprising;

a heat roller having an outer surface; and first and second pressing rollers disposed to be in contact with said heat roller at upstream and downstream positions, respectively, in a direction of rotation of said heat roller, wherein the curvature radius of a nipping portion of said second pressing roller is made to be larger than the curvature radius of said heat roller and the curvature radius of a nipping portion of said pressing roller disposed at the upstream position, and wherein said first pressing roller melts a toner and said second pressing roller fixes the toner on a printing sheet.

22. The toner fixing apparatus according to claim 21, wherein a recording-medium guide means is disposed between said first and second pressing rollers and structured to cover the outer surface of said heat roller so as to guide the recording medium.

23. A toner fixing apparatus according to claim 21, wherein said first and second pressing rollers are made of first and second materials, wherein said first material is softer than said second material.

24. A toner fixing apparatus comprising:

a heat roller; and two pressing rollers disposed to be in contact with said heat roller at upstream and downstream positions respectively in a direction of rotations of said heat roller, wherein the temperature of the surface of the nipping portion of said pressing roller disposed in the upstream position is made to be lower than the temperature of the surface of the nipping portion of said pressing roller disposed at the downstream position, and the heat capacity of said pressing roller disposed in the upstream position is made to be larger than the heat capacity of said pressing roller at the downstream position.

25. The toner fixing apparatus according to claim 24, wherein the thermal conductivity of said pressing roller disposed in the upstream position is made to be smaller than the thermal conductivity of said pressing roller disposed at the downstream position.

26. The toner fixing apparatus according to claim 24, wherein the outer diameter of said pressing roller disposed in the upstream position is made to be larger than the outer diameter of said pressing roller disposed at the downstream position.

27. The toner fixing apparatus according to claim 24, wherein said pressing roller disposed at the upstream position melts a toner and said pressing roller disposed at the downstream position fixes the toner on a printing sheet.

* * * * *